US009058007B2

(12) United States Patent
Iijima et al.

(10) Patent No.: US 9,058,007 B2
(45) Date of Patent: Jun. 16, 2015

(54) TORQUE TRANSMITTING MEMBER DISPOSED AT AN END OF A PHOTOSENSITIVE DRUM, PHOTOSENSITIVE DRUM UNIT, AND PROCESS CARTRIDGE

(71) Applicant: MITSUBISHI CHEMICAL CORPORATION, Chiyoda-ku (JP)

(72) Inventors: Shinichi Iijima, Jurong (SG); Shuichi Ikeda, Odawara (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 15 days.

(21) Appl. No.: 13/967,875

(22) Filed: Aug. 15, 2013

(65) Prior Publication Data

US 2014/0072342 A1 Mar. 13, 2014

Related U.S. Application Data

(60) Provisional application No. 61/698,168, filed on Sep. 7, 2012.

(30) Foreign Application Priority Data

Oct. 19, 2012 (JP) ..... 2012-006387 U
May 15, 2013 (JP) ..... 2013-103332

(51) Int. Cl.
*G03G 15/00* (2006.01)
*G03G 21/18* (2006.01)

(52) U.S. Cl.
CPC ..... *G03G 15/757* (2013.01); *G03G 21/1857* (2013.01)

(58) Field of Classification Search
USPC ..... 399/167
See application file for complete search history.

(56) References Cited

U.S. PATENT DOCUMENTS 1,912,412 A 6/1933 Stubbs
3,734,548 A 5/1973 Kieves (Continued)

FOREIGN PATENT DOCUMENTS

EP 0 735 432 A1 10/1996
FR 2 356 046 6/1976

(Continued)

OTHER PUBLICATIONS

Signer, "Polygon Fixed and Sliding Drive Connections . . . New Developments in Their Application and Manufacture," Technical Paper, Society of Manufacturing Engineers, 1974.

*Primary Examiner* — Quana M Grainger
(74) *Attorney, Agent, or Firm* — Oblon, McClelland, Maier & Neustadt, L.L.P.

(57) ABSTRACT

There is provided a torque transmitting member that appropriately maintains conductivity between an image forming apparatus body and a photosensitive drum and can suppress the occurrence of conduction failure. A torque transmitting member, which is disposed at an end portion of a photosensitive drum unit and transmits torque, includes: an cylindrical end member that includes a bearing portion at one end portion thereof and a fitting portion, which is inserted into a photosensitive drum, at the other end portion thereof; and a conductive conducting shaft member that is disposed so as to extend along a cylindrical shaft of the end member and includes a conductive material, which is elastically deformed, on at least a part thereof.

6 Claims, 24 Drawing Sheets

(56) References Cited

U.S. PATENT DOCUMENTS

| | | | | |
|---|---|---|---|---|
| 4,829,335 | A | 5/1989 | Kanemitsu et al. | |
| 5,023,660 | A | 6/1991 | Ebata et al. | |
| 5,128,715 | A | 7/1992 | Furuyama et al. | |
| 5,132,728 | A | 7/1992 | Suzaki et al. | |
| 5,221,943 | A | 6/1993 | Hasegawa | |
| 5,245,376 | A | 9/1993 | Takahashi | |
| 5,277,531 | A | 1/1994 | Krivec | |
| 5,669,046 | A | 9/1997 | Yoshida et al. | |
| 5,903,803 | A | 5/1999 | Kawai et al. | |
| 5,926,673 | A | 7/1999 | Foster et al. | |
| 5,987,287 | A | 11/1999 | Huang | |
| 6,006,058 | A | 12/1999 | Watanabe et al. | |
| 6,035,159 | A | 3/2000 | Azuma et al. | |
| 6,128,454 | A | 10/2000 | Kawai et al. | |
| 6,163,665 | A | 12/2000 | Watanabe et al. | |
| 6,173,146 | B1 | 1/2001 | Wang et al. | |
| 6,175,706 | B1 | 1/2001 | Watanabe et al. | |
| 6,185,390 | B1 | 2/2001 | Higeta et al. | |
| 6,226,478 | B1 | 5/2001 | Watanabe et al. | |
| 6,240,266 | B1 | 5/2001 | Watanabe et al. | |
| 6,324,363 | B1 | 11/2001 | Watanabe et al. | |
| 6,336,018 | B1 | 1/2002 | Kawai et al. | |
| 6,349,188 | B1 | 2/2002 | Kawai et al. | |
| 6,385,420 | B1 | 5/2002 | Morioka | |
| 6,400,914 | B1 * | 6/2002 | Noda et al. | 399/167 |
| 6,438,341 | B1 | 8/2002 | Matsuoka | |
| 6,501,926 | B1 | 12/2002 | Watanabe et al. | |
| 6,501,927 | B1 | 12/2002 | Watanabe et al. | |
| 6,885,838 | B2 | 4/2005 | Kawai et al. | |
| 6,898,399 | B2 | 5/2005 | Morioka et al. | |
| 6,999,696 | B2 | 2/2006 | Noda et al. | |
| 7,236,722 | B2 | 6/2007 | Portig | |
| 7,433,631 | B2 | 10/2008 | Karz et al. | |
| 7,537,410 | B2 | 5/2009 | Parisi et al. | |
| 7,813,676 | B2 | 10/2010 | Huck et al. | |
| 2001/0021320 | A1 | 9/2001 | Murayama et al. | |
| 2002/0044794 | A1 | 4/2002 | Nishiuwatoko et al. | |
| 2002/0110388 | A1 | 8/2002 | Yokomori et al. | |
| 2003/0053823 | A1 | 3/2003 | Cho et al. | |
| 2003/0059233 | A1 | 3/2003 | Jang et al. | |
| 2004/0086300 | A1 | 5/2004 | Kawai et al. | |
| 2005/0163526 | A1 | 7/2005 | Kawai et al. | |
| 2005/0192092 | A1 | 9/2005 | Breckner et al. | |
| 2005/0254858 | A1 | 11/2005 | Numagami et al. | |
| 2006/0008287 | A1 | 1/2006 | Noda et al. | |
| 2006/0198654 | A1 | 9/2006 | Noda et al. | |
| 2007/0104510 | A1 | 5/2007 | Kawai et al. | |
| 2007/0104511 | A1 | 5/2007 | Kawai et al. | |
| 2007/0140735 | A1 | 6/2007 | Karz et al. | |
| 2008/0056754 | A1 | 3/2008 | Noda et al. | |
| 2008/0056764 | A1 | 3/2008 | Chung | |
| 2009/0010681 | A1 | 1/2009 | Huck et al. | |
| 2009/0257779 | A1 | 10/2009 | Shimura et al. | |
| 2009/0279917 | A1 | 11/2009 | Tsui et al. | |
| 2009/0290908 | A1 | 11/2009 | Noda et al. | |
| 2012/0045247 | A1 | 2/2012 | Lewis | |
| 2013/0183063 | A1 | 7/2013 | Huck et al. | |

FOREIGN PATENT DOCUMENTS

| | | |
|---|---|---|
| GB | 446033 | 4/1936 |
| JP | 49-91645 | 8/1974 |
| JP | 64-21466 | 1/1989 |
| JP | 4-5949 | 1/1992 |
| JP | 6-185531 | 7/1994 |
| JP | 6-258993 | 9/1994 |
| JP | 6-332346 | 12/1994 |
| JP | 2000-112200 | 4/2000 |
| JP | 2002-525657 | 8/2002 |
| JP | 3352609 | 9/2002 |

* cited by examiner

TORQUE TRANSMITTING MEMBER DISPOSED AT AN END OF A PHOTOSENSITIVE DRUM, PHOTOSENSITIVE DRUM UNIT, AND PROCESS CARTRIDGE

BACKGROUND OF THE INVENTION

The present invention relates to a torque transmitting member that is used in an image forming apparatus, such as a laser printer or a copy machine, a photosensitive drum unit that includes the torque transmitting member, and a process cartridge.

An image forming apparatus, such as a laser printer or a copy machine, is provided with a process cartridge that can be mounted on and separated from an image forming apparatus body (hereinafter, referred to as an "apparatus body").

The process cartridge is a member that forms contents to be shown, such as letters and figures, at a posture where the process cartridge is mounted on the apparatus body and transfers the contents to a recording medium such as paper. For this reason, the process cartridge is provided with a photosensitive drum on which contents to be transferred are formed and means (charging means and developing means) for forming the contents to be transferred to the photosensitive drum.

The same process cartridge as the process cartridge is mounted on and separated from the apparatus body for the purpose of maintenance, or an old process cartridge is separated from the apparatus body and a new process cartridge is mounted on the apparatus body for the replacement of the old process cartridge with a new process cartridge. Since the mounting and separation of the process cartridge are performed by a user of the image forming apparatus, it is preferable that the mounting and separation of the process cartridge can be easily performed as much as possible from such a point of view.

Incidentally, the photosensitive drum included in the process cartridge needs to be rotated when being operated. Further, the photosensitive drum is provided with a bearing member, and the bearing member is directly engaged with a rotary drive shaft of the apparatus body or is engaged with the rotary drive shaft through other members. Accordingly, the photosensitive drum receives torque from the drive shaft and rotates.

Meanwhile, in order to mount and separate the process cartridge on and from the apparatus body as described above, it is necessary to disengage (separate) the drive shaft of the apparatus body from the bearing member of the photosensitive drum and to engage the drive shaft with the bearing member again each time.

In addition, since the photosensitive drum is charged by a voltage applied from the apparatus body through the charging roller and develops an image to be formed by this charged state, charging and the elimination of electricity are performed as necessary in the respective processes for forming and transferring the image. The photosensitive drum is electrically conducted to the apparatus body at the time of the elimination of electricity, so that grounding is achieved.

Patent Documents 1 and 2 disclose an aspect that includes a ground plate (sheet metal plate) as means (conducting means) for electrically conducting a photosensitive drum to an apparatus body. The ground plate is disposed in the photosensitive drum so as to close the inner portion of the photosensitive drum, and is a conductive plate-like member formed so that at least a part of the outer peripheral portion of the ground plate comes into contact with the inner peripheral surface of the photosensitive drum.

In Patent Document 1, a conductive shaft, which extends from the apparatus body passing through a flange (end member) and inserted into the photosensitive drum, can conduct electricity by coming into contact with contact pieces of the ground plate. In this case, the contact pieces are formed so as to be capable of being elastically deformed in the form of a leaf spring.

In Patent Document 2, a conducting shaft, which comes into electrical contact with the ground plate, is enclosed in an end member and the conducting shaft can conduct electricity by coming into contact with a conductive pin of the image forming apparatus. Here, a technique in which a contact point of the apparatus body is rotated and moved in an axial direction and always comes into contact with the same contact point to suppress the occurrence of conduction failure is disclosed in order to stabilize the conduction between the apparatus body and the photosensitive drum.

RELATED ART DOCUMENT

Patent Document

[Patent Document 1] Japanese Patent No. 3352609
[Patent Document 2] JP-A-2000-112200

However, in the technique in which the conductive shaft extending from the apparatus body is directly inserted into the ground plate as disclosed in Patent Document 1, the shaft needs to be pulled out from and inserted into the ground plate whenever the photosensitive drum is mounted and separated. Further, since the shape of the ground plate is complex if the ground plate has the function of an elastic member, there is a concern that conduction failure caused by accuracy occurs. Furthermore, the elastic property of the ground plate can be adjusted by a material, a heat treatment of a material, and the shape of the ground plate, but the range of the elastic property of the ground plate is limited. Even if a desired elastic property can be detected, experimental production or numerical analysis are required to obtain the desired elastic property. For this reason, time is required to make the design.

Meanwhile, according to the technique disclosed in Patent Document 2, the direct electrical contact point between the apparatus body and the photosensitive drum is an abutting portion between the shaft-like members. Accordingly, the contact and separation accompanying the mounting and separation of the photosensitive drum easily occur. Incidentally, the conducting mechanism disclosed in Patent Document 2 needs to make the contact point of the photosensitive drum follow the movement of the contact point of the apparatus body. However, it is difficult to make the contact point of the photosensitive drum follow the movement of the contact point of the apparatus body in the structure disclosed in Patent Document 2. Further, if the contact point of the photosensitive drum cannot follow the movement of the contact point of the apparatus body, the conductive pin of the apparatus body and the contact point of the photosensitive drum alternately come into contact with each other and are separated from each other. For this reason, conduction is not achieved periodically. Furthermore, the photosensitive drum is pushed back together by the piston motion of the conductive pin of the apparatus body. For this reason, there is a concern that a rotation transmission coupling (a run-out triangular prism in Patent Document 2) is disengaged and idles.

SUMMARY

Accordingly, the invention has been made in consideration of the above-mentioned problem, and an object of the invention is to provide a torque transmitting member that can appropriately maintain conductivity between an image forming apparatus body and a photosensitive drum and suppress the occurrence of conduction failure. Further, the invention provides a photosensitive drum unit including the torque transmitting member, and a process cartridge.

It is therefore an aspect of the invention to provide a torque transmitting member that is disposed at an end portion of a photosensitive drum unit and transmits torque, the torque transmitting member including:

a cylindrical end member that includes a bearing portion at one end portion thereof and a fitting portion at the other end portion thereof, the fitting portion being inserted into a photosensitive drum; and a conductive conducting shaft member that is disposed so as to extend along a cylindrical shaft of the end member and includes a conductive material, which is elastically deformed, on at least a part thereof.

The conductive material may be at least one of a coil spring, a conductive sheet, a brush made of metal, and wool made of metal.

The torque transmitting member may be formed so that an end portion of the conducting shaft member is accessible from the bearing portion.

A ground plate, which is a conductive plate-like member, may be disposed at a portion of the end member close to the fitting portion and an end portion of the conducting shaft member comes into contact with the ground plate.

The conductive material, which is elastically deformed, of the conducting shaft member may include a coil spring, a hole may be formed at the ground plate, and the coil spring may be caught in the hole of the ground plate.

It is therefore another aspect of the invention to provide a photosensitive drum unit comprising:

a cylindrical photosensitive drum; and the torque transmitting member according to any one of the above, wherein the fitting portion is inserted into at least one end portion of the photosensitive drum, so that the torque transmitting member is mounted.

It is still another aspect of the invention to provide process cartridge comprising:

the photosensitive drum unit according to the above;

a charging roller that charges the photosensitive drum of the photosensitive drum unit; and a developing roller that develops an electrostatic latent image on the photosensitive drum, wherein the photosensitive drum unit, the charging roller, and the developing roller are held in a same housing.

BRIEF DESCRIPTION OF THE DRAWINGS

FIGS. 21A and 21B are views showing a bearing member 230'.

DETAILED DESCRIPTION OF EMBODIMENTS

Figure 1:
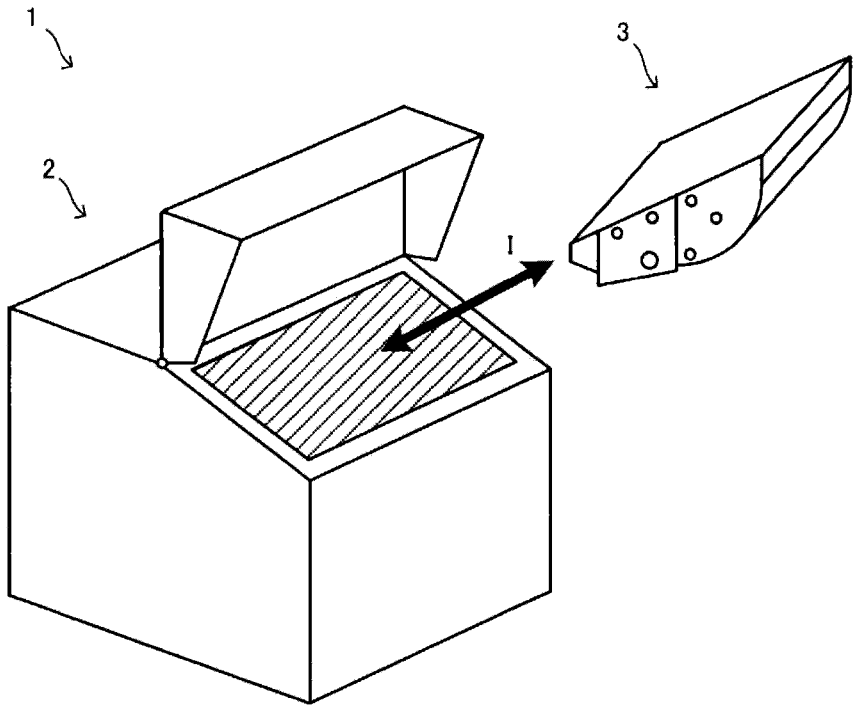
FIG. 1 is a schematic view showing an image forming apparatus 1.

The operation and advantages of the invention will become apparent from embodiments of the invention to be described below. The invention will be described below on the basis of embodiments shown in the drawings. However, the invention is not limited to these embodiments.

FIG. 1 is a view showing a first embodiment and is a schematic perspective view of an image forming apparatus 1 that includes a process cartridge 3 and an image forming apparatus body 2 (hereinafter, referred to as an "apparatus body 2") used for the mounting of the process cartridge 3. It is possible to mount and separate the apparatus body 2 on and from the apparatus body 2 by moving the process cartridge 3 in a direction that is shown in FIG. 1 by an arrow I.

The apparatus body 2 includes a drive shaft 51 that will be described below. Well-known structure may be applied to other portions of the apparatus body 2.

Figure 2A:
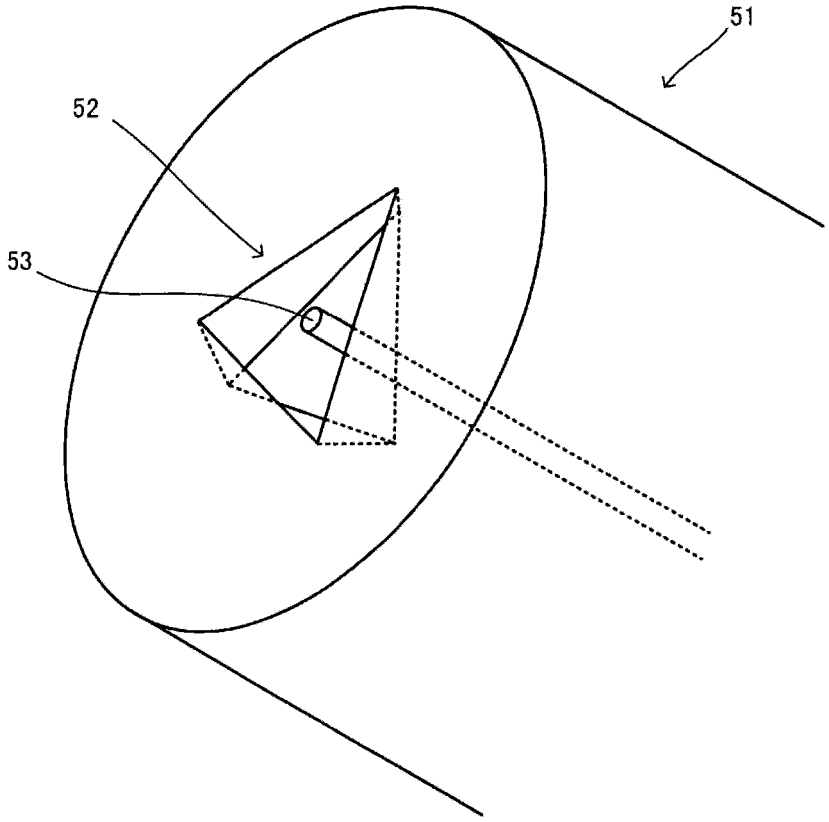
FIG. 2A is a perspective view showing one end portion of a drive shaft 51 and FIG. 2B is a front view showing one end portion of the drive shaft 51.
Figure 2B:
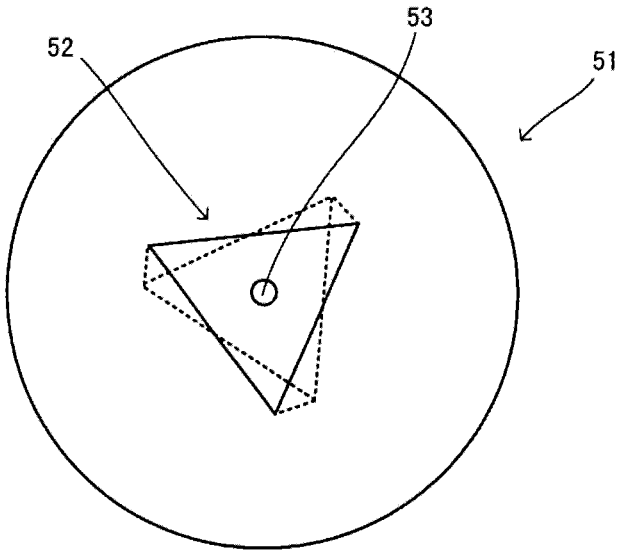
Figure 3:
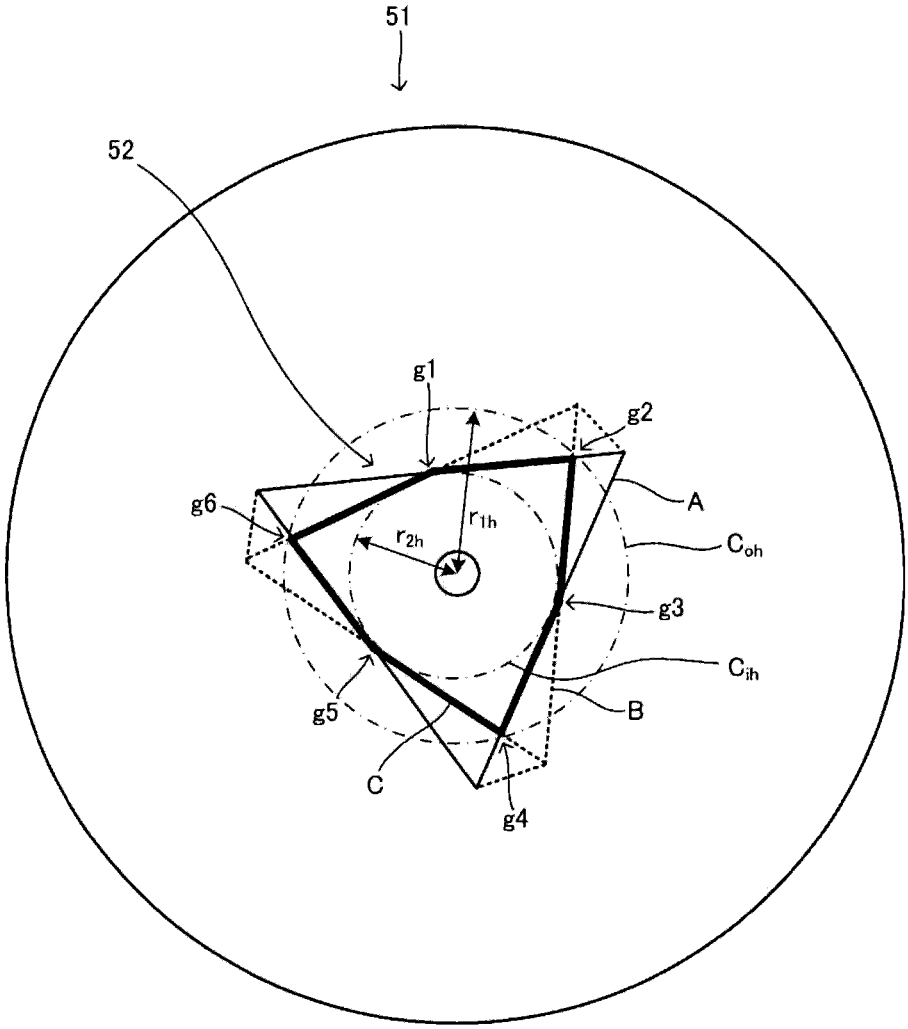
FIG. 3 is a view showing the shape of a recess 52.

The drive shaft 51 of the apparatus body 2 will be described first. One end portion, which is engaged with a bearing member 30 (see FIG. 6), of the drive shaft 51 that is provided in the apparatus body 2 and applies drive torque to a photosensitive drum unit 10 (see FIG. 5) is shown in FIGS. 2A and 2B. FIG. 2A is a perspective view and FIG. 2B is a front view. A part of a recess 52 is perspectively shown in FIGS. 2A and 2B by a broken line. The other end portion of the drive shaft 51 is directly or indirectly connected to a drive source of the apparatus body 2. Further, FIG. 3 is a view that is seen in the same viewpoint as FIG. 2B and is a view showing the shape of the recess 52.

As understood from FIGS. 2A and 2B, the recess 52 is formed at the end portion of the drive shaft 51. The recess 52 is a hole that has a substantially equilateral triangular cross-section and has a shape twisted about an axis at a predetermined angle from the end face of the drive shaft 51 in a depth direction parallel to an axial direction. The direction of the twist may be a clockwise direction or a counterclockwise direction according to a rotation transmitting direction.

Accordingly, the recess 52 can be defined as a volume that is formed between an opening formed at the end face of the drive shaft 51 and the bottom of the recess 52 and is surrounded by side walls of the recess 52.

Further, a body-side ground member 53, which has conductivity and the shape of a rod, is disposed in the drive shaft 51 along the rotation axis of the drive shaft 51. One end portion of the body-side ground member 53 protrudes so as to be erected from the bottom of the recess 52 as shown in FIGS. 2A and 2B. Meanwhile, the other end portion of the body-side ground member 53 protrudes from the other end portion of the drive shaft 51, and comes into contact with a ground member of the apparatus body 2.

As understood from FIG. 2B, the recess 52 is shown so that a triangle formed at the opening of the recess 52 and a triangle formed at the bottom of the recess 52 are shown as two triangles rotating relative to each other about an axis and overlapping each other when the recess 52 is perspectively seen from the front in the axial direction. The following characteristics are defined from this form.

In FIG. 3, the triangle formed at the opening of the recess 52 is denoted by reference letter A and the triangle formed at the bottom of the recess 52 is denoted by reference letter B. Here, when the recess 52 is seen from the viewpoint of FIG. 3, a hexagon C having vertexes g1 to g6 is formed in an inner portion surrounded by the two triangles A and B (the hexagon C is shown in FIG. 3 by a thick line). Further, a circumscribed circle of the hexagon C is denoted by $C_{oh}$, an inscribed circle of the hexagon C is denoted by $C_{ih}$, a radius of the $C_{oh}$ is denoted by $r_{1h}$, and a radius of $C_{ih}$ is denoted by $r_{2h}$.

Since the radius $r_{2h}$ has a predetermined relationship with the shape of the bearing member 30 as described below, it is possible to reliably transmit torque.

Figure 4:
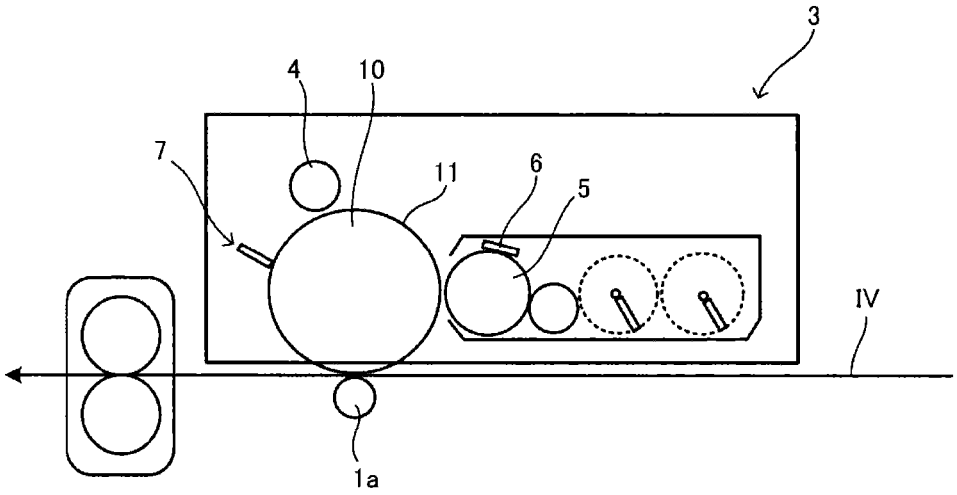
FIG. 4 is a view conceptually showing the structure of a process cartridge 3.

Next, the process cartridge 3 will be described. FIG. 4 schematically shows the structure of the process cartridge 3. As understood from FIG. 4, the process cartridge 3 includes a photosensitive drum unit 10 (see FIG. 5), a charging roller 4, a developing roller 5, a regulating member 6, and a cleaning blade 7. When a recording medium such as paper is moved along a line, which is denoted by IV in FIG. 4, at a posture where the process cartridge 3 is mounted on the apparatus body 2, an image is transferred to the recording medium.

As described in detail below, the mounting and separation of the process cartridge 3 on and from the apparatus body 2 are generally performed in the following manner. Since the photosensitive drum unit 10 of the process cartridge 3 receives drive torque transmitted from the apparatus body 2 and rotates, the drive shaft 51 (see FIG. 2) of the apparatus body 2 and the bearing member 30 (see FIG. 6) of the photosensitive drum unit 10 need to be engaged with each other during at least the operation. In addition, at that time, the apparatus body 2 and the photosensitive drum unit 10 can conduct electricity due to the following structure.

Meanwhile, when the process cartridge 3 is mounted on and separated from the apparatus body 2, the engagement between the drive shaft 51 of the apparatus body 2 and the bearing member 30 of the photosensitive drum unit 10 needs to be released. At this time, the electrical conduction between the apparatus body 2 and the photosensitive drum unit 10 is also released.

Further, since the drive shaft 51 of the apparatus body 2 is adapted so as to be movable in the axial direction thereof, the drive shaft 51 is in a posture where the drive shaft 51 is separated from the bearing member 30 of the photosensitive drum unit 10 when the process cartridge 3 is mounted and separated. Meanwhile, after the process cartridge 3 is mounted on the apparatus body 2, the drive shaft 51 is moved and engaged with the bearing member 30 of the photosensitive drum unit 10. At this time, the electrical conduction between the apparatus body 2 and the photosensitive drum unit 10 is also performed.

It is preferable that the drive shaft 51 of the apparatus body 2 and the bearing member 30 of the photosensitive drum unit transmit appropriate drive torque and be smoothly engaged with and disengaged from each other as described above.

Each structure will be described below.

As described above, the process cartridge 3 includes the charging roller 4, the developing roller 5, the regulating member 6, the cleaning blade 7, and the photosensitive drum unit 10, and each of them has the following structure.

The charging roller 4 charges a photosensitive drum 11 of the photosensitive drum unit 10 by a voltage applied from the apparatus body 2. The charging of the photosensitive drum 11 is performed when the charging roller 4 is rotated following the photosensitive drum 11 and comes into contact with the outer peripheral surface of the photosensitive drum 11.

The developing roller 5 is a roller that supplies a developer to the photosensitive drum 11. Further, an electrostatic latent image formed on the photosensitive drum 11 is developed by the developing roller 5. Meanwhile, a fixed magnet is built in the developing roller 5.

The regulating member 6 is a member that adjusts the amount of a developer adhering to the outer peripheral surface of the developing roller 5 and applies a triboelectric charge to the developer.

The cleaning blade 7 is a blade that comes into contact with the outer peripheral surface of the photosensitive drum 11 so as to remove a developer, which remains after transfer, by the tip thereof.

When an image is formed using the above-mentioned respective components, the above-mentioned charging or the elimination of electricity, which releases the charging, are performed as necessary. The elimination of electricity can be performed when the photosensitive drum 11 and the apparatus body 2 conduct electricity and are grounded.

Figure 5:
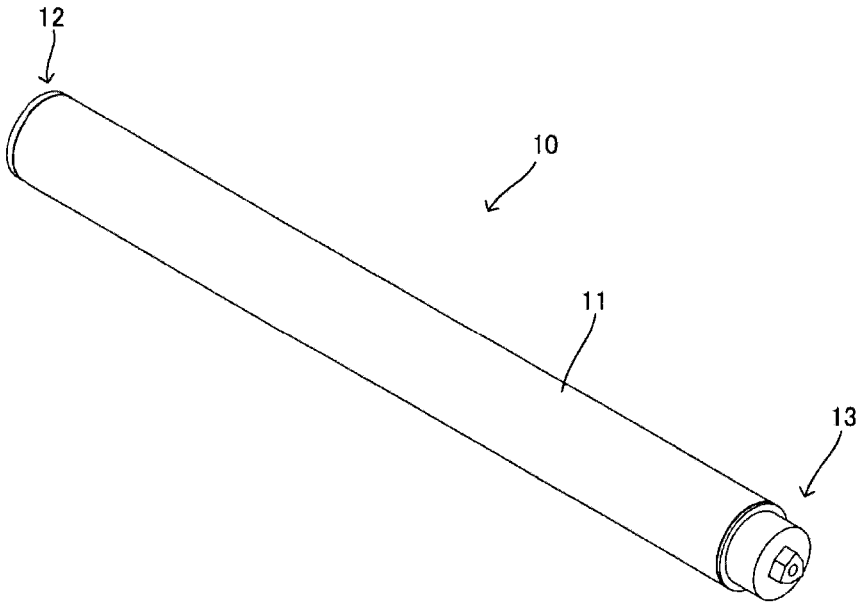
FIG. 5 is a perspective view of the appearance of a photosensitive drum unit 10.

The photosensitive drum unit 10 includes the photosensitive drum 11, and letters, figures, and the like to be transferred are formed on the photosensitive drum 11. FIG. 5 is a perspective view of the appearance of the photosensitive drum unit 10. As understood from FIG. 5, the photosensitive drum unit 10 includes the photosensitive drum 11, a lid 12, and a torque transmitting member 13.

A photosensitive drum 11 is a member of which the outer peripheral surface of a cylindrical base is covered with a photosensitive layer. Letters, figures, and the like, which are to be transferred to a recording medium such as paper, are formed on the photosensitive layer.

The base is made of a conductive material, such as aluminum or an aluminum alloy, in a cylindrical shape. The kind of an aluminum alloy used as the base is not particularly limited, but it is preferable that a material used as the base of the photosensitive drum be 6000 series aluminum alloy, 5000 series aluminum alloy, or 3000 series aluminum alloy specified in JIS (Japanese Industrial Standard).

Further, the photosensitive layer formed on the outer peripheral surface of the base is not particularly limited, and a well-known material may be applied according to the purpose of the photosensitive layer.

It is possible to manufacture the base in a cylindrical shape by cutting, extruding, drawing, or the like. Furthermore, it is possible to produce the photosensitive drum 11 by laminating a photosensitive layer on the outer peripheral surface of the base through application or the like.

The torque transmitting member 13 is mounted on one end of the photosensitive drum 11 as described below, and the lid 12 is disposed on the other end of the photosensitive drum 11.

The lid 12 is a member that is made of a resin, and includes a fitting portion that is fitted into a cylindrical portion of the photosensitive drum 11 and a bearing portion that is disposed so as to cover one end face of the photosensitive drum 11. The fitting portion and the bearing portion are coaxially combined with each other. The bearing portion is formed in the shape of a disc that covers the end face of the photosensitive drum 11, and includes a portion that receives a shaft of the apparatus body.

Meanwhile, one example of the lid has been described in this embodiment. However, the lid is not limited thereto, and other forms of a lid, which can be generally used, may be applied. For example, a gear, which transmits torque, may be disposed on the lid.

Figure 6:
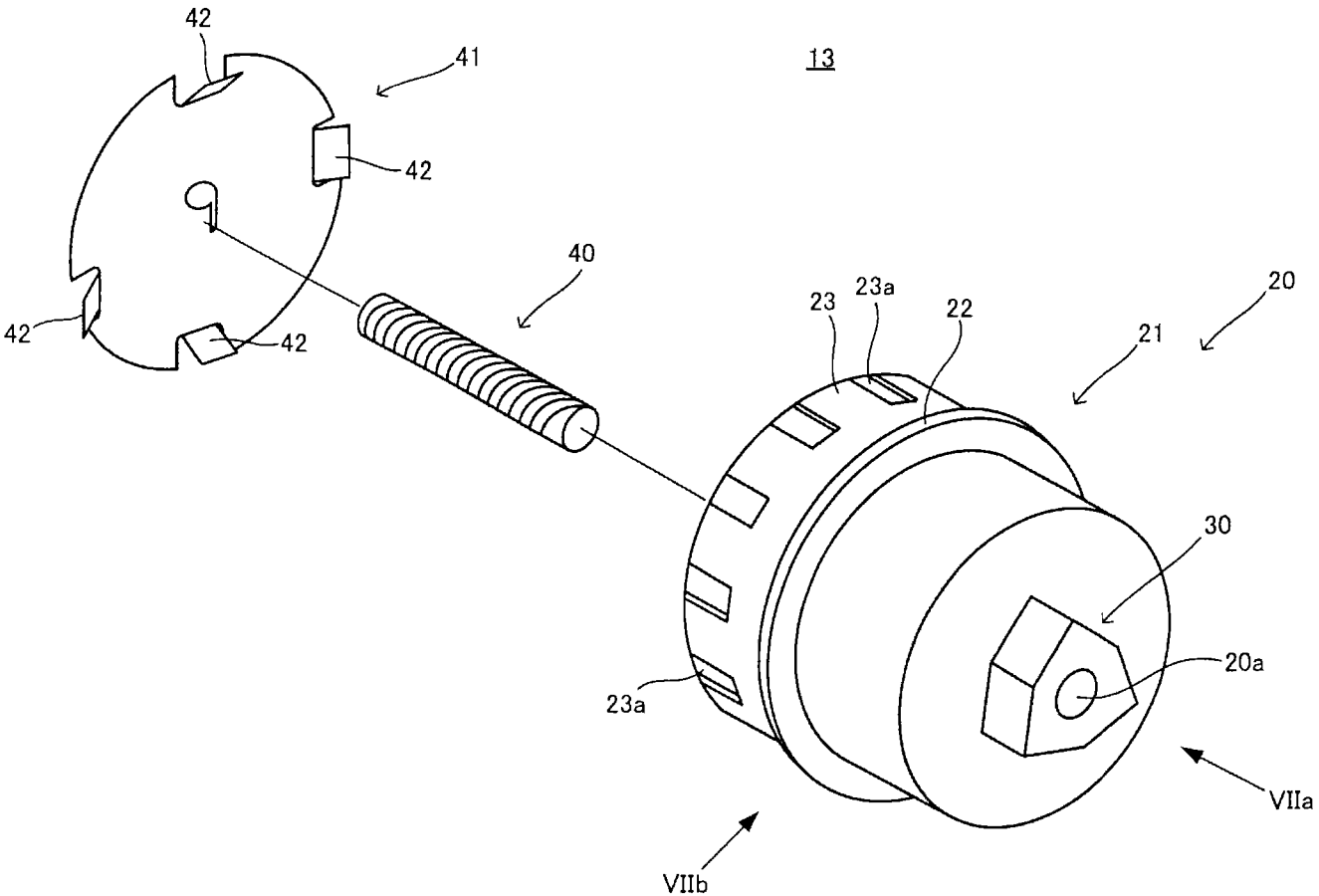
FIG. 6 is an exploded perspective view of a torque transmitting member 13.

The torque transmitting member 13 is a member mounted on the end portion, which is opposite to the lid 12, of the end portions of the photosensitive drum 11, and includes an end member 20 and a conducting member. In this embodiment, the conducting member includes a coil spring 40 as a conducting shaft member and a ground plate 41. FIG. 6 is an exploded perspective view of the torque transmitting member 13.

Figure 7A:
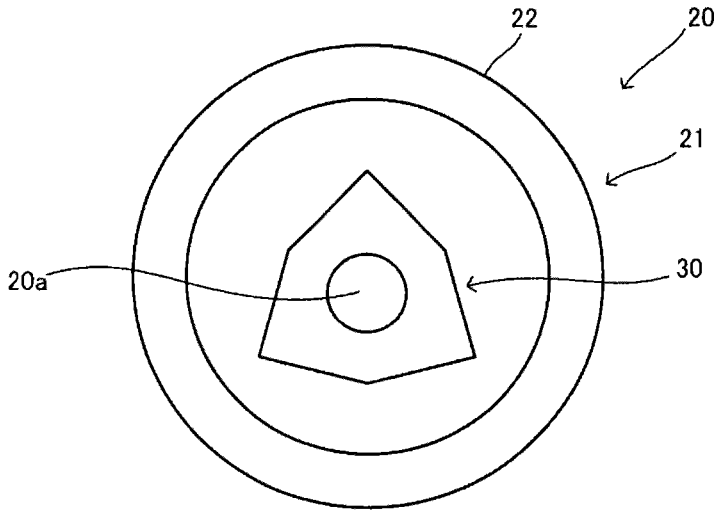
FIG. 7A is a front view of an end member 20 and FIG. 7B is a plan view of the end member 20.
Figure 7B:
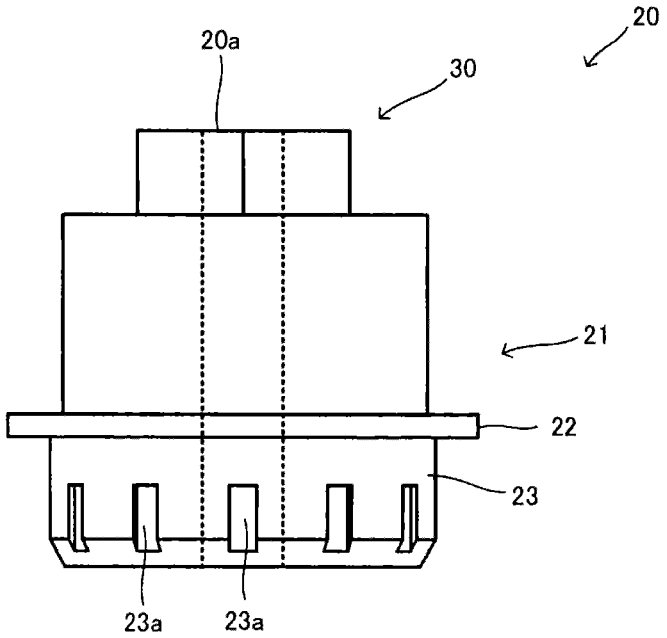

The end member 20 is a member that is fixed to the end portion of the photosensitive drum 11 and has a function of receiving a drive force from the drive shaft 51 of the apparatus body 2 and rotating together with the photosensitive drum 11. The end member 20 includes a body 21 and the bearing member 30. FIG. 7 shows a front view and a plan view of the end member 20. FIG. 7A is a front view of the end member 20 that is seen in a direction denoted by VIIa in FIG. 6, and FIG. 7B is a plan view of the end member 20 that is seen in a direction denoted by VIIb in FIG. 6.

The body 21 and the bearing member 30 are formed integrally with each other in this embodiment as understood from FIGS. 5 to 7, so that the end member 20 is formed. Further, the body 21 is mounted on the photosensitive drum 11 and the bearing member 30 formed integrally with the body 21 is engaged with the drive shaft 51 of the apparatus body 2, so that the end member 20 receives drive torque and rotates the photosensitive drum unit 10.

The body 21 is a member that has a cylindrical shape as a whole. A contact wall 22, which comes into contact with and is engaged with the end face of the photosensitive drum 11, is erected from a part of the outer peripheral surface of the body 21, and one side of the contact wall 22 forms a fitting portion 23 that is inserted into the photosensitive drum 11. Furthermore, the bearing member 30 is formed on the end face of the body 21, which corresponds to the other side of the contact wall 22, so as to protrude outward.

The contact wall 22 is a ring-shaped member that is erected from a part of the outer peripheral surface of the body 21. As understood from FIG. 5 (see also FIG. 11), the contact wall 22 is disposed so as to come into contact with the end face of the photosensitive drum 11 at a posture where the torque transmitting member 13 is mounted on the photosensitive drum 11. Accordingly, the insertion depth of the torque transmitting member 13 into the photosensitive drum 11 is regulated.

The fitting portion 23 is a portion of the body 21 that corresponds to one side of the contact wall 22. The fitting portion 23 is inserted into the photosensitive drum 11, and is fixed to the inner surface of the photosensitive drum 11 by an adhesive (see FIG. 11). Accordingly, the torque transmitting member 13 is fixed to the end portion of the photosensitive drum 11. Therefore, the outer diameter of the fitting portion 23 is substantially the same as the inner diameter of the photosensitive drum 11 in the range where the fitting portion 23 can be inserted into the cylindrical portion of the photosensitive drum 11.

Grooves 23*a* may be formed on the outer peripheral surface of the fitting portion 23. Accordingly, the grooves 23*a* are filled with an adhesive, so that adhesiveness between the end member 20 (the torque transmitting member 13) and the photosensitive drum 11 is improved by an anchor effect or the like.

The bearing member 30 is a member that is engaged with the recess 52 formed in the drive shaft 51 of the apparatus body 2 and has a function of transmitting torque, which is transmitted from the drive shaft 51, to the end member 20 of the torque transmitting member 13.

Further, the bearing member 30 is adapted so as to be separated from the recess 52 of the drive shaft 51 when the process cartridge 3 is mounted on and separated from the apparatus body 2. The bearing member 30 of this embodiment specifically has the following shape.

Figure 8:
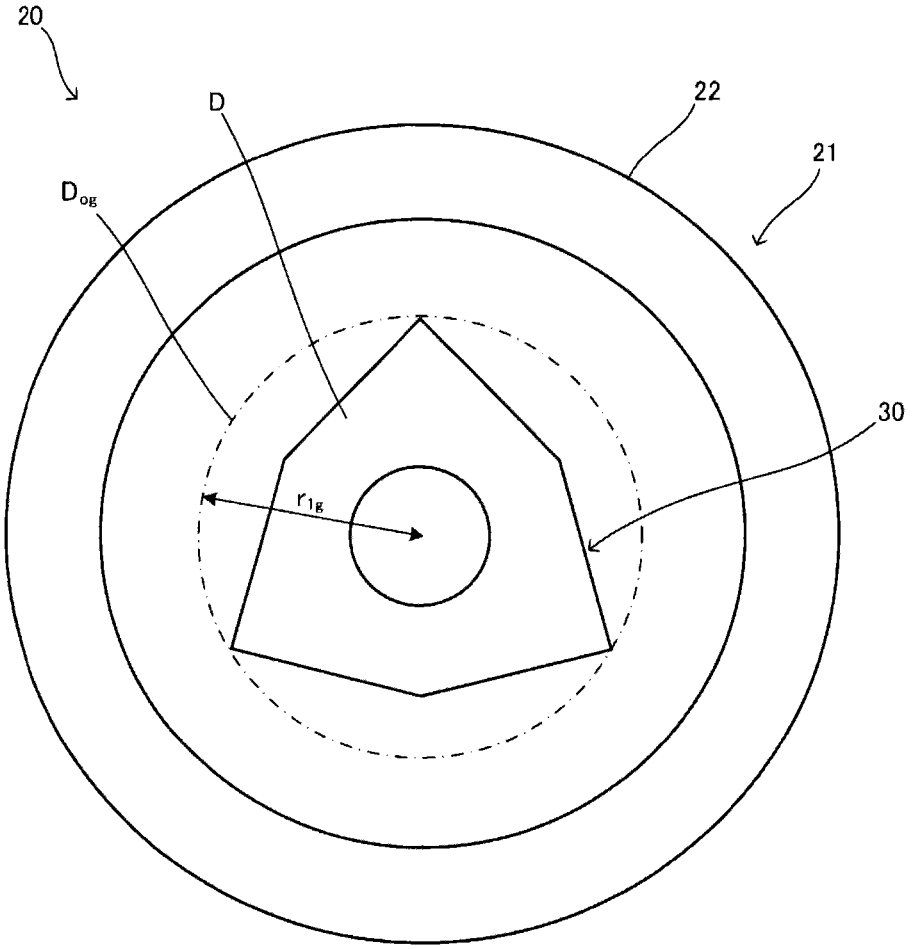
FIG. 8 is a view showing the shape of a bearing member 30.

As understood from FIGS. 7A and 7B, the bearing member 30 is a cylindrical body that is formed so as to protrude from the end face of the body 21 opposite to the fitting portion 23 in the axial direction. The shape of the outer periphery of the bearing member 30 on the cross-section orthogonal to the axial direction is a hexagonal shape, and the shape of the inner periphery of the bearing member 30 on the cross-section orthogonal to the axial direction is a circular shape. FIG. 8 is an enlarged view of FIG. 7A and shows the shape of the bearing member 30. The bearing member 30 has the shape of a hexagon D in the viewpoint of the FIG. 8 as described above. Here, a circumscribed circle of the hexagon D is denoted by $D_{og}$ and the radius of the circumscribed circle is denoted by $r_{1g}$. Further, it is preferable that the radius $r_{2h}$ of the inscribed circle $C_{ih}$ of the hexagon C of the recess 52 described in FIG. 3 and the radius $r_{1g}$ of the circumscribed circle $D_{og}$ of the hexagon D satisfy the relationship of the following expression (1).

$$r_{1g}-r_{2h}>0 \quad (1)$$

When the recess 52 of the drive shaft 51 and the bearing member 30 have the shapes that satisfy the relationship of Expression (1), it is possible to reliably transmit the drive torque, which is transmitted from the drive shaft 51, to the bearing member 30, the torque transmitting member 13 on which the bearing member 30 is provided, and to the photosensitive drum 11 without idling.

Moreover, since the bearing member 30 does not have a shape that is twisted about the axial direction, the bearing member 30 does not have undercut portions. That is, when the bearing member 30 is seen from the base-side end portion (the end portion close to the body 21) of the bearing member 30 in the axial direction (when the bearing member 30 is seen from the back side that is opposite to the viewpoint of the FIG. 8), other portions of the bearing member 30 are not seen.

Accordingly, when the bearing member 30 (the end member 20) is formed, the filling of a material in a mold and releasability are improved. Therefore, productivity is improved. Further, since the mold does not require a rotating mechanism such as a slide core or a frame, it is possible to simplify the structure of the mold itself.

Furthermore, it is preferable that the bearing member 30 be formed so that a volume share of the volume, into which the bearing member 30 is inserted, to the inner volume of the recess 52 which is formed in the drive shaft 51 of the apparatus body 2 and with which the bearing member 30 is engaged is in the range of 20% to 70%. In addition, it is more preferable that the bearing member 30 be formed so that the volume share is in the range of 30% to 70%.

Here, it is possible to obtain the volume share $O_v$ in the following manner. That is, when the volume of a portion of the bearing member 30, which is inserted into the recess 52, is denoted by V and the volume of the recess 52 is denoted by W, it is possible to obtain the volume share $O_v$ by the following expression (2).

$$O_v=(V/W)\times 100\% \quad (2)$$

When the volume share $O_v$ is smaller than 20%, there is a concern that the bearing member 30 idles without being engaged with the recess 52. Further, even if the bearing member 30 is engaged with the recess 52, there is a possibility that an engaged portion cannot endure the torque and is broken. In this case, since the bearing member 30 does not have sufficient stiffness in the rotation direction, the shaft may be twisted. Furthermore, there is a concern that an axis is deviated and the accuracy of the transmission of torque deteriorates.

Meanwhile, when the volume share $O_v$ exceeds 80%, the strength of the bearing member 30 itself is improved. However, since the volume share is excessively large when the bearing member 30 is engaged with the recess 52, there is a possibility that engagement and disengagement are not smoothly performed.

Here, one hole 20*a* is formed in the inner portion, which is a cylindrical body, of the body 21 and the bearing member 30 and passes through the body 21 and the bearing member 30 in the axial direction. The diameter of the hole 20*a* is set to a size where an end portion (see FIG. 2) of the body-side ground member 53 of the above-mentioned drive shaft 51 can be inserted.

It is preferable that the end member 20 be made of a crystalline resin. Since a crystalline resin flows well when being injection-molded using a mold, the moldability of the crystalline resin is excellent. Accordingly, even though the crystalline resin is not cooled to a glass transition point, the crystalline resin is crystallized and solidified and it is possible to separate the crystalline resin from the mold. Therefore, it is possible to significantly improve productivity. Further, it is preferable that the crystalline resin be applied as a material of the end member in terms of excellent heat resistance, solvent resistance, oil resistance, and grease resistance; good friction and abrasion resistance and slidability; and stiffness and hardness.

Examples of a crystalline resin include polyethylene, polypropylene, polyamide, polyacetal, polyethylene terephthalate, polybutylene terephthalate, methylpentene, polyphenylene sulfide, polyether ether ketone, polytetrafluoroethylene, and nylon.

It is preferable that a polyacetal resin among these be used in terms of moldability.

Moreover, glass fiber, carbon fiber, or the like may be filled in terms of the improvement of strength.

Returning to FIG. 6, the coil spring 40 will be described. The coil spring 40 is one member forming conducting means, is one form of a conducting shaft member, and functions as a conductive material that is elastically deformed. Specifically, the coil spring 40 of this embodiment is a helical spring that is formed of one wire coiled in a spiral shape. The outer diameter of the coil spring 40 is substantially the same as the diameter of the hole 20*a*, and the coil spring 40 is adapted to be capable of being inserted into the hole 20*a* as described below. Further, the coil spring 40 includes a conductive material, and is formed so as to be capable of conducting electricity. It is preferable that the coil spring 40 be made of metal such as steel or copper.

Figure 9:
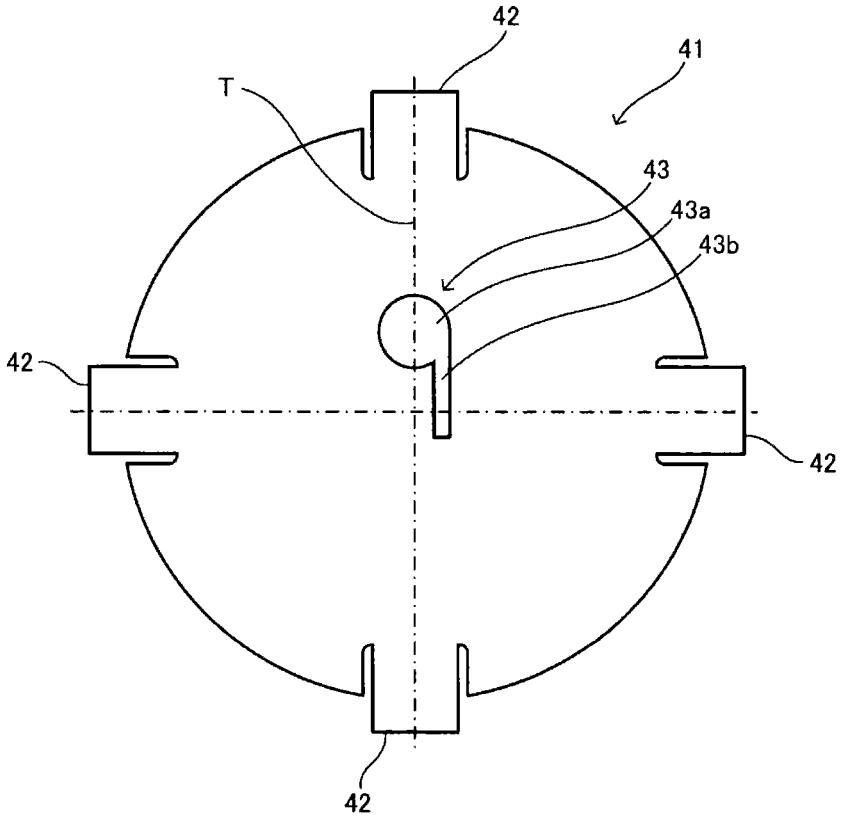
FIG. 9 is a front view of a ground plate 41.

The ground plate 41 is one member forming the conducting means, is a disc-shaped member having conductivity, and is adapted so that at least a part of the ground plate 41 comes into contact with the inner surface of the photosensitive drum 11. That is, the basic function of the ground plate 41 is the same as that of a well-known ground plate. For this reason, the structure of the ground plate 41 is not particularly limited, and a well-known shape can be applied. FIG. 9 is a view of the ground plate 41 as one example that is seen from the front. Furthermore, the perspective view of the ground plate 41 is also shown in FIG. 6. As understood from FIGS. 6 and 9, the ground plate 41 has a substantially circular shape in front view. In this embodiment, four contact pawls 42 are disposed on the outer peripheral portion of the ground plate 41 at an interval of 90°. As understood from FIG. 9, the contact pawls 42 have a diameter larger than the diameters of other portions at the unfolded postures thereof and are formed so as to protrude from the outer periphery. The diameter of a circle, which connects the contact pawls 42 at the unfolded postures, is larger than the inner diameter of the photosensitive drum 11. Accordingly, when the ground plate 41 is assembled as the photosensitive drum unit 10, the protruding end portions of the contact pawls 42 come into contact with the inner surface of the photosensitive drum 11 while being bent (see FIGS. 6 and 11).

In addition, the ground plate 41 is provided with a hole 43 that can catch one end portion of the coil spring 40 as described below. The shape of the hole 43 is not particularly limited as long as the hole can catch one end portion of the coil spring 40. However, examples of the shape of the hole 43 may include the shape shown in FIG. 9. That is, a circular hole 43*a* that has a center on one diameter line (T) of the ground plate 41 at a position slightly away from the center of the ground plate 41 and a linear slit 43*b* that extends from the end portion of the hole 43*a* so as to be parallel to the diameter line (T) are formed.

Figure 10A:
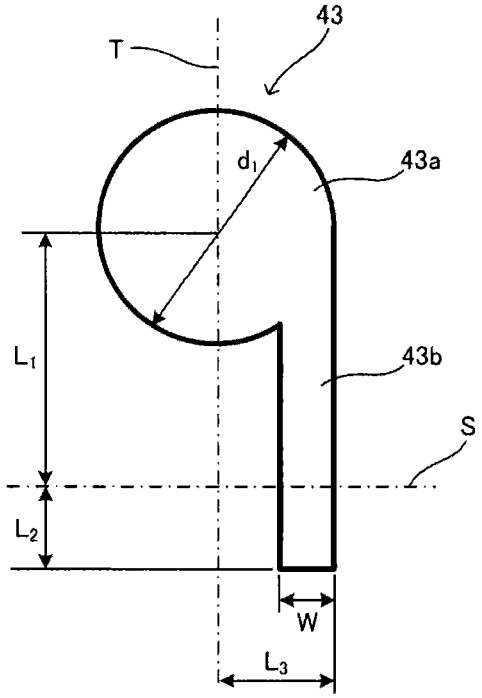
FIGS. 10A and 10B are views to explain the shape of a hole 43.
Figure 10B:
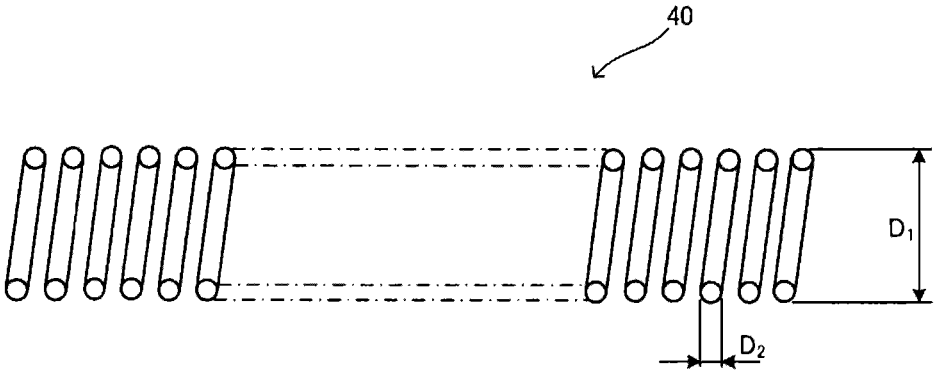

It is preferable that the shape of the hole 43 have the following relationships about the shape of the coil spring 40. In FIG. 10A, the dimensions of the respective portions of the hole 43 are denoted by symbols. In FIG. 10B, the dimensions of the respective portions of the coil spring 40 are denoted by symbols. The meanings of the respective symbols are as follows:

$d_1$: the diameter (mm) of the hole 43*a*

W: the width (mm) of the slit 43*b*

$L_1$: a distance (mm) between the center of the hole 43*a* and a diameter line S orthogonal to the diameter line T $L_2$: a distance (mm) between the diameter line S and the end portion of the slit 43*b*

$L_3$: a distance (mm) between the diameter line T and the most distant portion of the slit 43*b*

$D_1$: an outer diameter (mm) of the coil spring 40

$D_2$: the diameter (mm) of a wire of the coil spring 40

It is preferable that the above-mentioned respective dimensions have the following relationships.

$$d_1 \geq D_1$$

$$L_1 = 3 \cdot d_1$$

$$L_2 \approx D_1/2$$

$$L_3 \approx D_1/2$$

$$W \approx 2 \cdot D_2$$

When these relationships are satisfied, it is possible to make the end portion of the coil spring 40 easily be caught and held by the hole 43, and to make the end portion of the coil spring 40 not be easily separated from the hole after the end portion of the coil spring 40 is caught by the hole. Further, it is possible to dispose the coil spring 40 on the axis of the end member 20. This mounting method will be described later.

Figure 11:
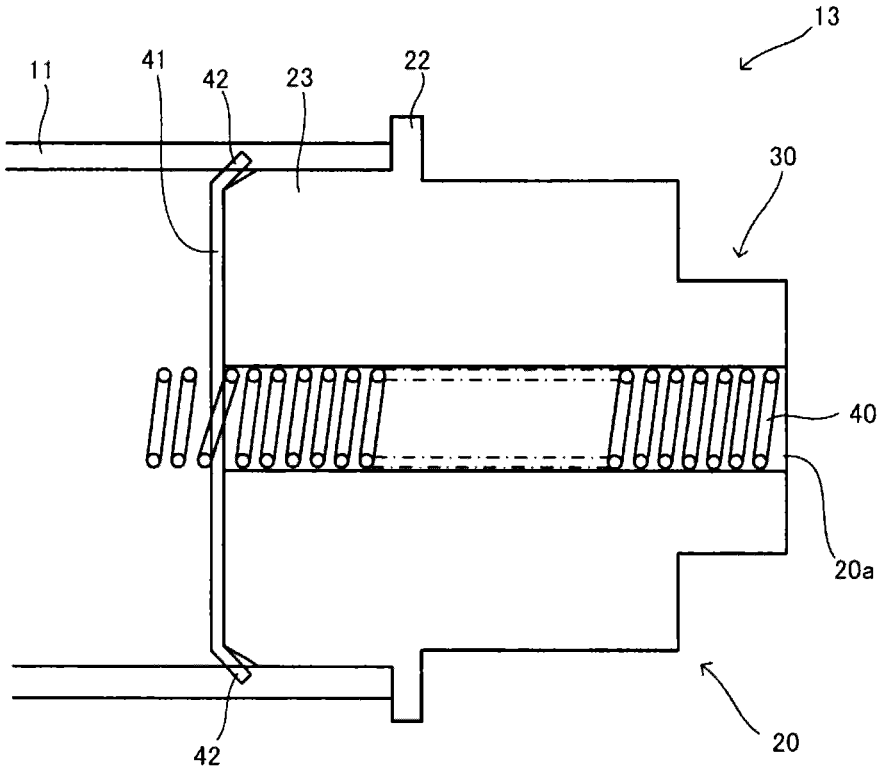
FIG. 11 is a cross-sectional view of one end portion of a photosensitive drum unit 10.

The torque transmitting member 13 is formed by the combination of the end member 20, the coil spring 40, and the ground plate 41 that have been described above. Further, the lid 12 is fixed to one end portion of the photosensitive drum 11 and the torque transmitting member 13 is fixed to the other end thereof as shown in FIG. 5, so that the photosensitive drum unit 10 is formed. FIG. 11 is a cross-sectional view of an end portion, on which the torque transmitting member 13 is disposed, of the end portions of the photosensitive drum unit 10 taken along the axial direction.

As understood from FIG. 11, the coil spring 40 is inserted into the hole 20*a* formed in the end member 20. Meanwhile, the ground plate 41 is disposed on an end face of the fitting portion 23 of the end member 20 so as to overlap the end face, and is fixed to the end face by an adhesive. Here, since the end portion, which is disposed close to the fitting portion 23, of the end portions of the coil spring 40 is caught by the hole 43 of the ground plate 41, the coil spring 40 is held by the ground plate 41.

The catching of the coil spring 40 by the ground plate 41 is performed, for example, in the following manner. FIGS. 12A to 14B are views sequentially showing the respective steps of catching the coil spring 40 by the ground plate 41.

Figure 12A:
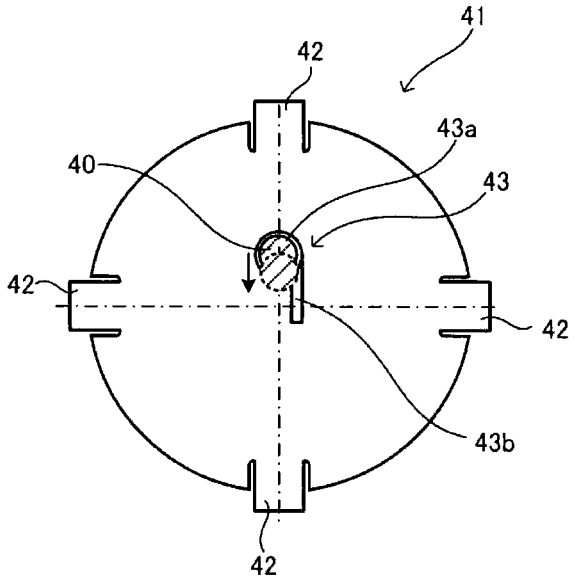
FIGS. 12A and 12B are views to explain one step of mounting a coil spring 40 on a ground plate 41.
Figure 12B:
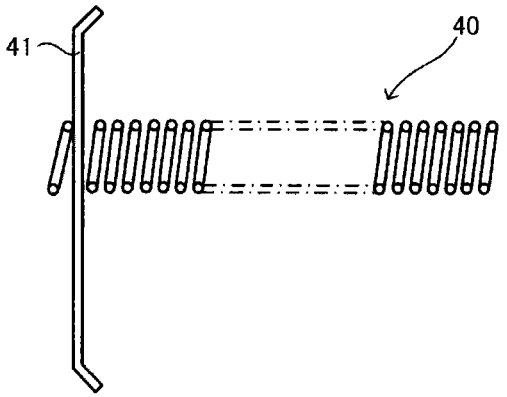

First, as shown in FIGS. 12A and 12B, one end portion of the coil spring 40 is inserted into the hole 43*a* of the ground plate 41. Further, as shown by a straight arrow in FIG. 12A, the coil spring 40 is moved toward the center of the ground plate 41. Accordingly, as understood from FIG. 12B, a part of the ground plate 41 is disposed between adjacent spiral wire portions of the coil spring 40.

Figure 13:
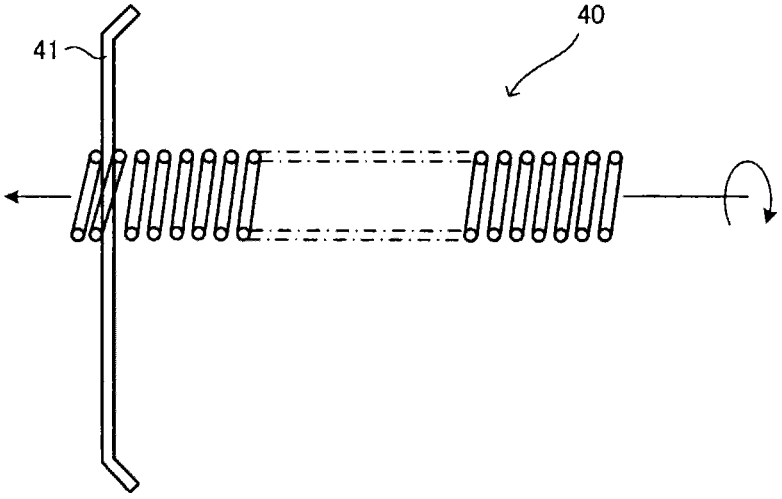
FIG. 13 is a view illustrating another step of mounting the coil spring 40 on the ground plate 41.

Next, as understood from FIG. 13, the coil spring 40 is rotated about the axis thereof. Since the coil spring 40 has a spiral shape, the coil spring 40 is advanced by this rotation as shown by a straight arrow in FIG. 13 and is caught by the ground plate 41 at a portion that is positioned on the inside of the end portion of the coil spring 40 in the longitudinal direction.

Figure 14A:
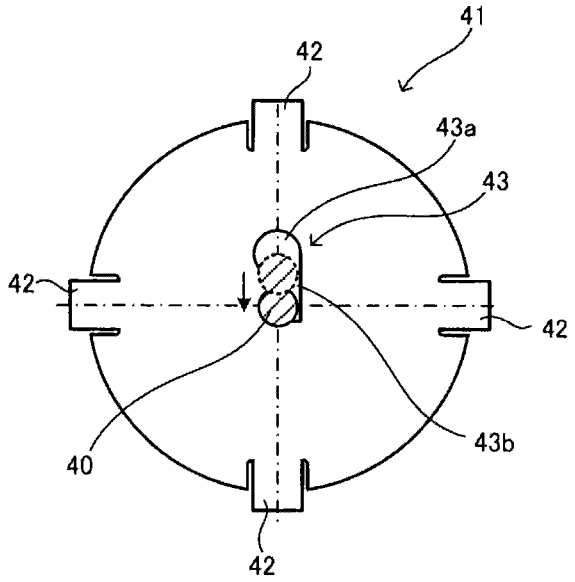
FIGS. 14A and 14B are views to explain another step of mounting the coil spring 40 on the ground plate 41.
Figure 14B:
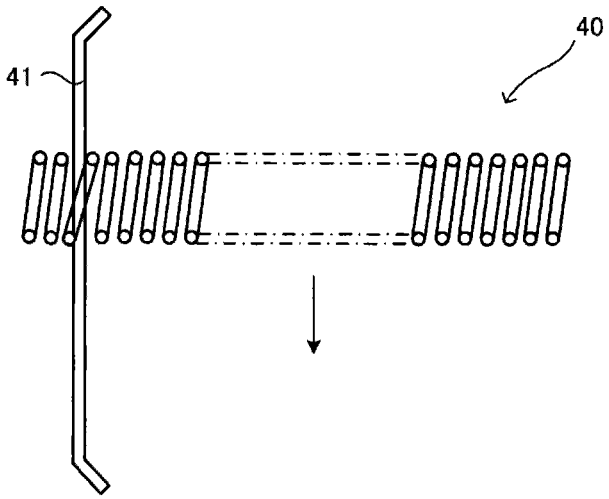

After that, as shown by straight arrows in FIGS. 14A and 14B, the coil spring 40 is moved toward the center of the ground plate 41. In this case, the wire portion of the coil spring 40 is moved in the slit 43*b*. Accordingly, the coil spring 40 is in the posture shown in FIG. 11.

If the coil spring 40 is adapted so as to be caught by the ground plate 41 as described above, the coil spring 40 can be easily engaged with the ground plate 41. Further, it is possible to dispose the coil spring 40 along the axis.

As understood from FIG. 11, the assembled torque transmitting member 13 is disposed so that the fitting portion 23 is inserted into the photosensitive drum 11, and is fixed by an adhesive. In this case, the ground plate 41 is also inserted into the photosensitive drum 11 and the contact pawls 42 come into contact with the inner surface of the photosensitive drum 11.

Figure 15:
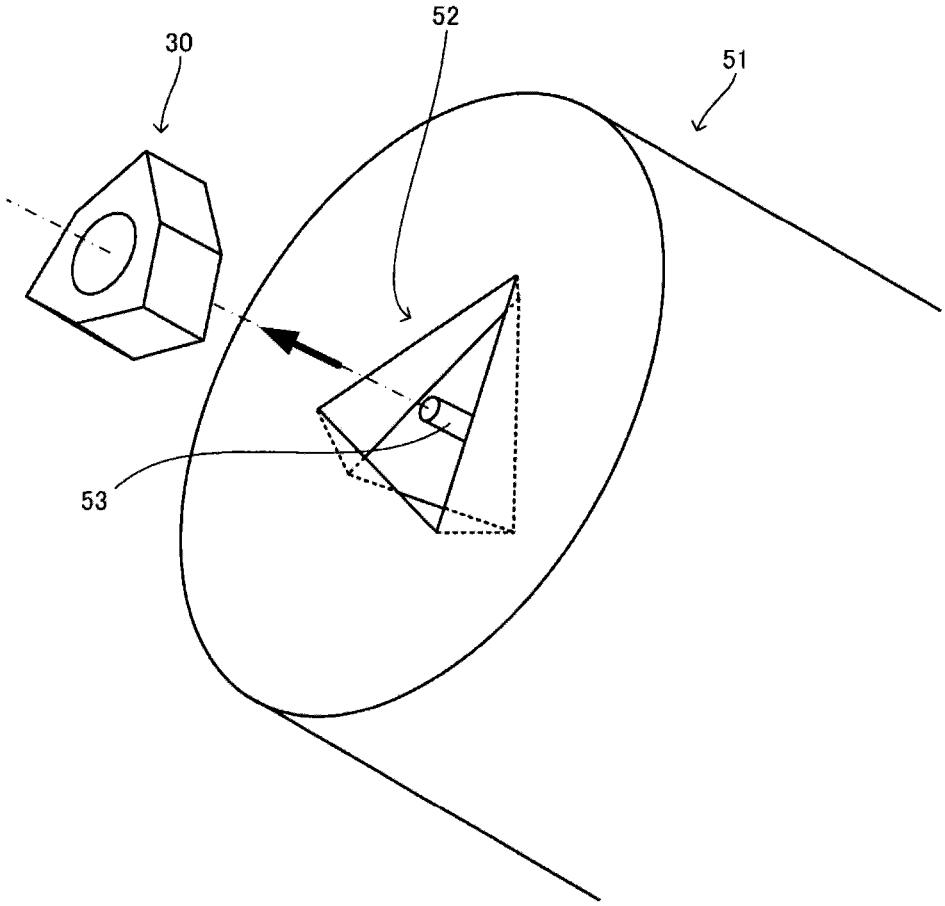
FIG. 15 is a perspective view illustrating the engagement between the bearing member 30 and the recess 52 of the drive shaft 51.
Figure 16:
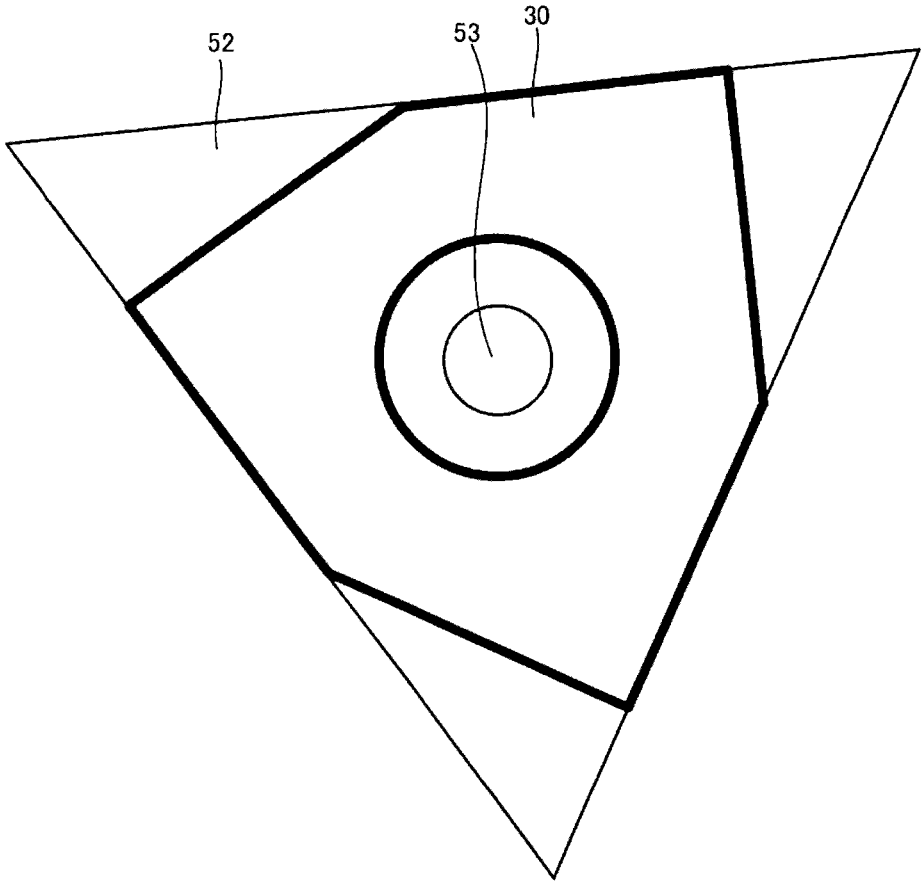
FIG. 16 is a front view illustrating the engagement between the bearing member 30 and the recess 52 of the drive shaft 51.
Figure 17:
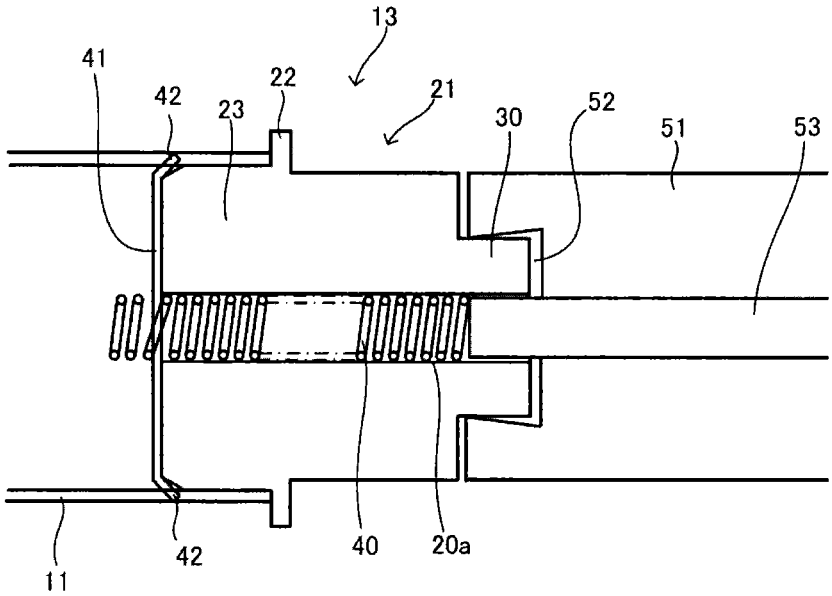
FIG. 17 is a cross-sectional view illustrating the engagement between the torque transmitting member 13 and the drive shaft 51.

FIGS. 15 to 17 are schematic views showing an aspect in which the torque transmitting member 13 of the photosensitive drum unit 10 and the recess 52 of the drive shaft 51 of the apparatus body 2 are engaged with each other. FIG. 15 is a perspective view schematically showing an aspect in which the bearing member 30 is being engaged with the recess 52, FIG. 16 is a front view showing a posture where the bearing member 30 is engaged with the recess 52, and FIG. 17 is a cross-sectional view taken along the axial direction at the posture where the bearing member 30 is engaged with the recess 52.

After the process cartridge 3 is mounted on the apparatus body 2 as understood from FIG. 15, the drive shaft 51 is moved in the axial direction so that the bearing member 30 is inserted into the recess 52. Further, after the bearing member 30 is inserted into the recess 52, a part or all of at least three surfaces of the hexagonal outer peripheral surfaces of the bearing member 30 come into contact with the ridge lines of the recess 52 close to the end face as shown in FIG. 16 and the bearing member 30 and the recess 52 are engaged with each other at a posture where drive torque around the axis can be transmitted.

When the drive shaft 51 and the bearing member 30 are engaged with each other, the drive shaft 51, the bearing member 30, the body 21, and the photosensitive drum 11 are coaxial with each other as understood from FIG. 17.

Further, since the bearing member 30 does not have undercut portions, it is possible to smoothly engage the bearing member 30 with the recess 52, and conversely, to smoothly disengage the bearing member 30 from the recess 52.

When the bearing member 30 is inserted into and engaged with the recess 52, the end portion of the body-side ground member 53 is inserted into the hole 20*a* of the end member 20 and presses the coil spring 40 while coming into contact with the coil spring 40 as shown in FIG. 17. Accordingly, the apparatus body 2 and the photosensitive drum 11 can conduct electricity through the coil spring 40 and the ground plate 41.

Since the body-side ground member 53 and the ground plate 41 can conduct electricity through the coil spring 40 that is elastically deformed in this embodiment, it is possible to absorb a pressing force, which is applied from the body-side ground member 53, by the coil spring 40. According to this, since the coil spring 40 follows the movement of the body-side ground member 53 so that a contact point is maintained, conductivity between the apparatus body and the photosensitive drum is appropriately maintained. It is possible to suppress the occurrence of conduction failure. Further, even in the case of the piston motion that is caused by the movement of the body-side ground member 53, the bearing member 30 is prevented from being separated from the recess 52 without being pushed back together with the photosensitive drum by the absorption. Meanwhile, a shaft is disposed between the body-side ground member and the ground plate in the related art and the shaft is integrated with the end portion by being press-fitted to the end member. Accordingly, when the shaft receives a pressing force from the body-side ground member, the shaft is pushed back together with the photosensitive drum. For this reason, the photosensitive drum is separated from the apparatus body.

Next, the manipulation and operation of the above-mentioned image forming apparatus 1 will be described.

It is possible to mount the process cartridge 3 on the apparatus body 2 by inserting the process cartridge 3 into the apparatus body 2 along a predetermined guide as shown in FIG. 1. In this case, the drive shaft 51 of the apparatus body 2 is in a posture where the drive shaft 51 retracts from the moving track of the process cartridge 3.

After the process cartridge 3 is received at a predetermined position in the apparatus body 2, the drive shaft 51 is moved toward the process cartridge 3 as shown in FIG. 15 while interlocking with an operation for closing the lid of the apparatus body 2 or by other operations, and the bearing member 30 is inserted into the recess 52 of the drive shaft 51 as shown in FIG. 16. Accordingly, the bearing member 30 and the recess 52 are coaxially engaged with each other. Therefore, drive torque transmitted from the apparatus body 2 is transmitted to the bearing member 30, the end member 20, and the photosensitive drum 11, so that the bearing member 30, the end member 20, and the photosensitive drum 11 can be rotated about an axis while interlocking with each other. Further, the drive torque transmitted from the apparatus body 2 is directly transmitted to other components (for example, the charging roller 4) of the process cartridge 3 or is transmitted to other components of the process cartridge 3 through other members, so that these components also can be rotated.

The process cartridge 3 is mounted as described above, and the image forming apparatus is operated at a posture where the photosensitive drum 11 and the like can be rotated. When predetermined letters or figures are to be formed on a recording medium, drive torque is applied from the apparatus body 2, so that the photosensitive drum unit 10 is rotated. Accordingly, the photosensitive drum 11 is charged by the charging roller 4.

While the photosensitive drum unit 10 is rotated, the photosensitive drum 11 is irradiated with a laser beam corresponding to image information by various optical members (not shown). Accordingly, an electrostatic latent image based on the image information is obtained. This latent image is developed by the developing roller 5.

Meanwhile, the recording medium such as paper is set on another portion of the apparatus body 2, is conveyed to a transfer position by feed rollers, conveying rollers, and the like provided in the apparatus body 2, and is moved along the line IV of FIG. 4. Transfer means 1*a* is disposed at the transfer position, and a voltage is applied to the transfer means 1*a* as the recording medium passes. Accordingly, the image is transferred to the recording medium from the photosensitive drum 11. After that, heat and pressure are applied to the recording medium, so that the image is fixed to the recording medium. Further, the recording medium on which the image has been formed is discharged from the apparatus body 2 by discharge rollers or the like.

Furthermore, to stand by for the next image on the photosensitive drum 11, the cleaning blade 7 comes into contact with the outer peripheral surface of the photosensitive drum 11 to remove developer, which remains after transfer, by the tip thereof. The developer, which is scraped by the cleaning blade 7, is discharged in a well-known manner.

When an image is formed by the above-mentioned processes, the elimination of electricity, which releases the charging, is performed in addition to charging as necessary. That is, when the photosensitive drum 11, the ground plate 41, the coil spring 40, and the body-side ground member 53 of the drive shaft 51 come into contact with each other as shown in FIG. 17, grounding is achieved and electricity can be eliminated. Further, at the time of elimination of electricity, the photoreceptor of the photosensitive drum 11 is irradiated with electricity eliminating light so as to be converted into a conductor and charges are made to flow to the photosensitive drum 11, the ground plate 41, the coil spring 40, and the body-side ground member 53 so that grounding is performed. The timing of the elimination of electricity is the same as the well-known timing of the elimination of electricity, but may be, for example, the time when the electrostatic latent image is obtained or the time before cleaning is performed.

For example, the outline of the bearing member 30, which has been described hitherto, has a hexagonal shape in plan view as shown in FIG. 7A. However, as long as the bearing member can transmit torque, the outline of the bearing member does not need to necessarily have the hexagonal shape and other shapes may be applied.

Figure 18A:
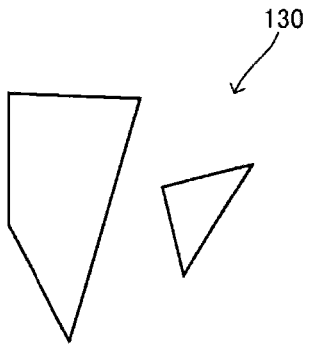
FIGS. 18A and 18B are views showing a bearing member 130
Figure 19A:
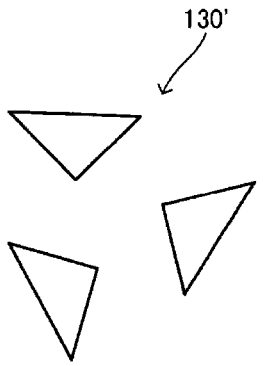
FIGS. 19A and 19B are views showing a bearing member 130'.
Figure 18B:
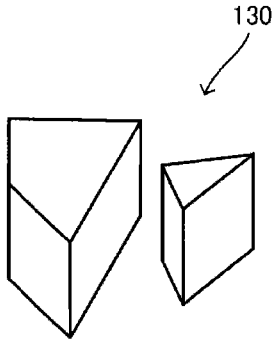
Figure 19B:
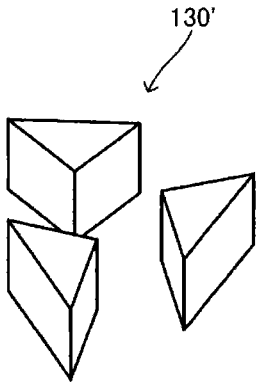

FIGS. 18A and 18B are views showing a bearing member 130 included in a first modification, where FIG. 18A is a front view, and FIG. 18B is a perspective view. FIGS. 19A and 19B are views showing a bearing member 130' included in a second modification, where FIG. 19A is a front view, and FIG. 19B is a perspective view.

Each of the bearing members 130 and 130' is an example in which a bearing member is formed of a plurality of portions. According to this, it is possible to avoid the unnecessary contact of the bearing member with the recess by removing surfaces other than the surfaces that transmit torque.

Figure 20A:
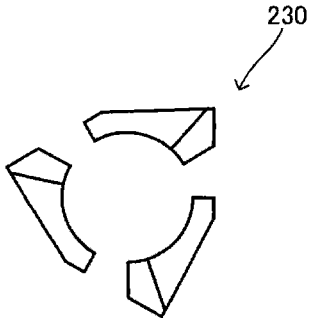
FIGS. 20A and 20B are views showing a bearing member 230
Figure 21B:
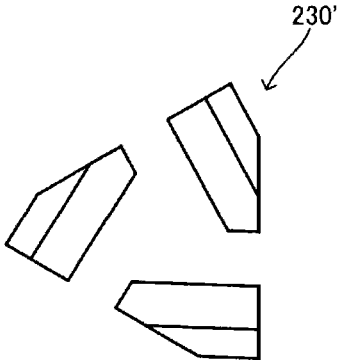
Figure 20B:
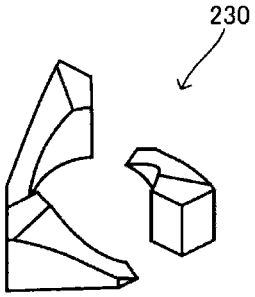
Figure 21B:
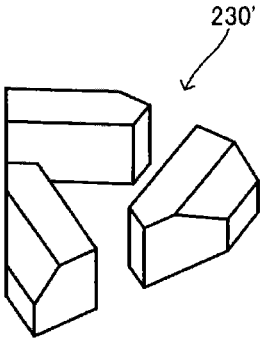

FIGS. 20A and 20B are views showing a bearing member 230 included in a third modification, where FIG. 20A is a front view, and FIG. 20B is a perspective view. FIGS. 21A and 21B are views showing a bearing member 230' included in a fourth modification, where FIG. 21A is a front view, and FIG. 21B is a perspective view.

Each of the bearing members 230 and 230' is an example in which an edge portion of a bearing member is chamfered (tapered). Even according to this, it is possible to avoid the unnecessary contact of the bearing member with the recess by removing surfaces other than the surfaces that transmit torque.

Figure 22:
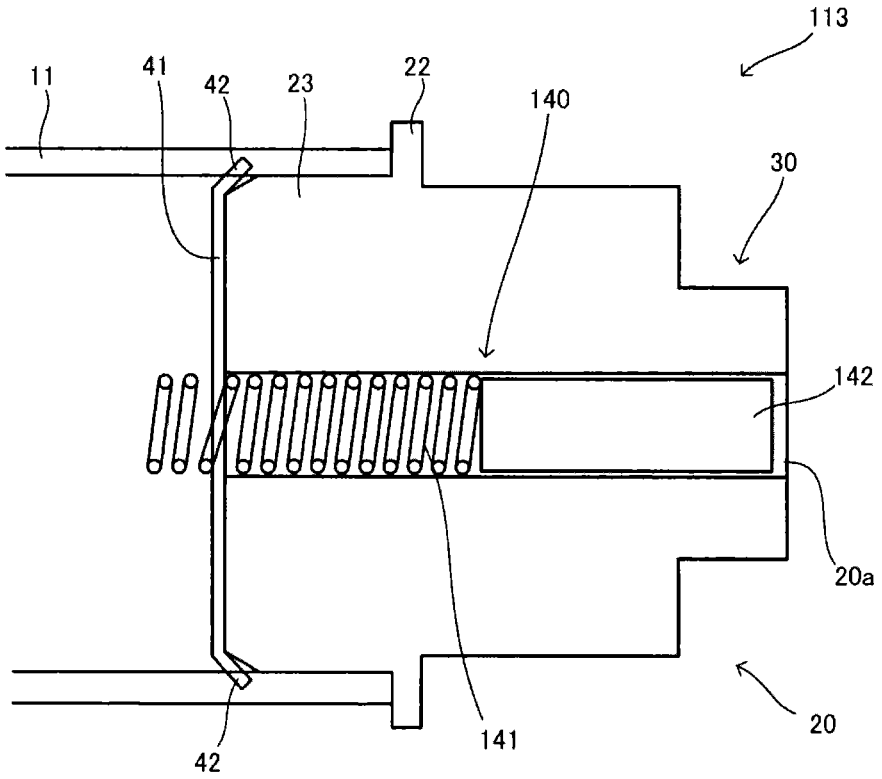
FIG. 22 is a view showing a torque transmitting member 113 according to a second embodiment.

FIG. 22 is a view illustrating a second embodiment, and is a view corresponding to FIG. 11. In the second embodiment, a torque transmitting member 113 is provided and, a conducting shaft member 140 is provided here instead of the conducting shaft member 40 of the conducting means. Since other portions are the same as those of the first embodiment, the description of the other portions will be omitted here.

In the embodiment, the conducting shaft member 140 includes a coil spring 141 and a conducting shaft 142.

The coil spring 141 is a helical spring shorter than the above-mentioned coil spring 40, but is the same as the coil spring 40 except for this. Accordingly, the coil spring 141 functions as a conductive material that is elastically deformed, and is disposed in the hole 20*a* of the end member 20. Further, one end of the coil spring 141 is caught by the ground plate 41.

The conducting shaft 142 is a rod-shaped member having conductivity, has a thickness received in the hole 20*a*, and has a length set so that one end of the conducting shaft 142 comes into contact with the coil spring 141 and the other end of the conducting shaft 142 reaches the vicinity of an opening portion of the hole 20*a* opposite to the side on which the ground plate 41 is disposed. The conducting shaft 142 may be made of metal such as copper or steel.

Here, the torque transmitting member 113 may be provided with means (retainer) for regulating the separation movement of the conducting shaft 142 at a predetermined position in order to prevent the conducting shaft 142 from being unnecessarily moved toward the apparatus body (the right side in FIG. 22). Examples of this means include a structure in which a part of the hole 20*a* may be narrowed so as to catch an end portion of the conducting shaft 142 close to the apparatus body.

Meanwhile, in this embodiment, the connection between the ground plate 41 and the coil spring 141 is the same as that of the first embodiment. However, the connection between the ground plate 41 and the coil spring 141 is not limited thereto, and may be a connection using a well-known method.

In this embodiment, the body-side ground member 53 of the apparatus body 2 is inserted into the hole 20*a* and comes into contact with the conducting shaft 142 at a posture where the photosensitive drum unit 10 is mounted on the apparatus body 2. Accordingly, electricity is conducted through a path of the coil spring 141, the ground plate 41, and the photosensitive drum 11.

The torque transmitting member 113 also functions in the same manner as the torque transmitting member 13 by the elastic deformation of the coil spring 141, and can absorb the movement of the body-side ground member 53 in the axial direction. Accordingly, the same effect is obtained.

Figure 23:
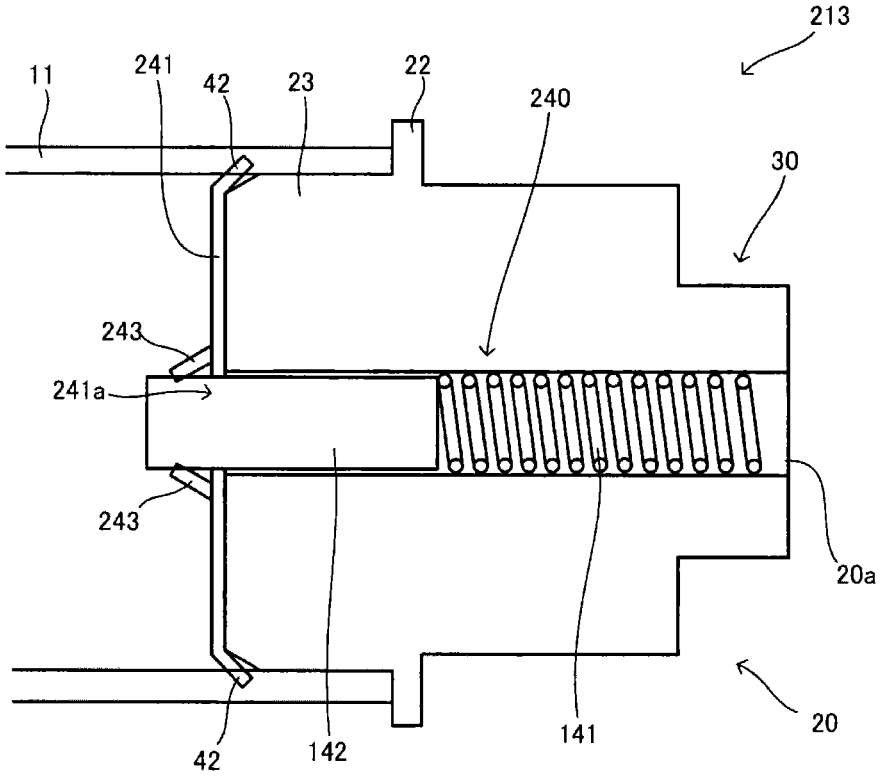
FIG. 23 is a view showing a torque transmitting member 213 according to a third embodiment.

FIG. 23 is a view illustrating a third embodiment, and is a view corresponding to FIG. 22. In the third embodiment, a torque transmitting member 213 is provided and a conducting shaft member 240 is provided here instead of the conducting shaft member 140 of the conducting means. In this embodiment, in the hole 20*a* of the end member 20, one end portion of the conducting shaft 142 described in the conducting shaft member 140 is connected to a ground plate 241 and the coil spring 141 is disposed on the side opposite to the ground plate 241 at the other end portion of the conducting shaft 142. In this embodiment, the conducting shaft 142 and the coil spring 141 are joined to each other by a well-known method, such as welding or caulking.

In this case, one end of the conducting shaft 142 is disposed so as to pass through a hole 241*a* that is formed at the center of the ground plate 241. In this case, it is preferable that contact pieces 243 be provided to make the conducting shaft 142 and the ground plate 241 reliably come into contact with each other. The outer peripheral portion of the ground plate 241 comes into contact with the inner peripheral surface of the photosensitive drum 11 by contact pawls 42 in the same manner as the ground plate 41.

In this embodiment, the body-side ground member 53 of the apparatus body 2 is inserted into the hole 20*a* and comes into contact with the coil spring 141 at a posture where the photosensitive drum unit 10 is mounted on the apparatus body 2. Accordingly, electricity is conducted through a path of conducting shaft 142, the ground plate 241, and the photosensitive drum 11.

The torque transmitting member 213 also functions in the same manner as the torque transmitting member 13 by the elastic deformation of the coil spring 241, and can absorb the movement of the body-side ground member 53 in the axial direction. Accordingly, the same effect is obtained.

Figure 24:
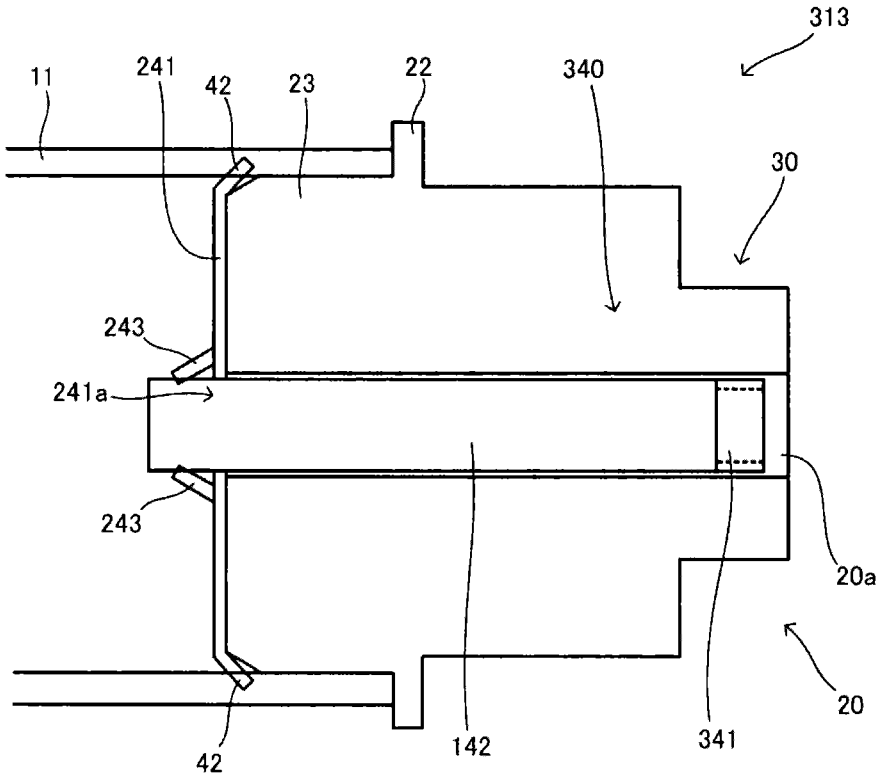
FIG. 24 is a view showing a torque transmitting member 313 according to a fourth embodiment.

FIG. 24 is a view illustrating a fourth embodiment, and is a view corresponding to FIG. 23. In the fourth embodiment, a torque transmitting member 313 is provided and a conducting shaft member 340 is provided here instead of the conducting shaft member 240 of the conducting means. Further, in this embodiment, a conductive sheet 341, which is formed in a cylindrical shape, is disposed instead of the coil spring 141 described in the conducting shaft member 240.

The conductive sheet 341 is obtained by forming a sheet-like member, which has conductivity and is elastically deformed, in a cylindrical shape, and functions as a conductive material. The conductive sheet 341 is disposed in the hole 20*a* of the end member 20, and one end portion of the conductive sheet 341 having a cylindrical shape comes into contact with an end portion of the conducting shaft 142 opposite to the ground plate 241. In this embodiment, the conducting shaft 142 and the conductive sheet 341 are joined to each other by a well-known method using, for example, a conductivity adhesive or the like. Meanwhile, the other end portion of the conductive sheet 341 having a cylindrical shape extends to the vicinity of an opening portion of the hole 20*a* of the end member 20 opposite to the ground plate 241.

Moreover, the diameter of the cylindrical inner space of the conductive sheet 341 is slightly smaller than the outer diameter of the body-side ground member 53.

In this embodiment, when the photosensitive drum unit 10 is mounted on the apparatus body 2, the body-side ground member 53 is inserted into the hole 20*a* and is also inserted into the conductive sheet 341. Accordingly, the outer peripheral surface of the body-side ground member 53 comes into contact with the inner surface of the conductive sheet 341. Therefore, electricity is conducted through a path of the conducting shaft 142, the ground plate 241, and the photosensitive drum 11. In this case, since the body-side ground member 53 is inserted while elastically deforming the conductive sheet 341, it is possible to obtain a good contact state. The conductive sheet 341 may be made of, for example, conductive rubber.

In the torque transmitting member 313, even when the body-side ground member 53 moves in the axial direction, the body-side ground member 53 merely moves while elastically deforming the cylindrical inner surface of the conductive sheet 341 and the tip of the body-side ground member 53 does not come into contact with the conducting shaft 142. Accordingly, the conducting shaft 142 also affects the movement of the body-side ground member 53 less in the axial direction, so that the same effect as the effect of the above-mentioned torque transmitting member is obtained.

Figure 25:
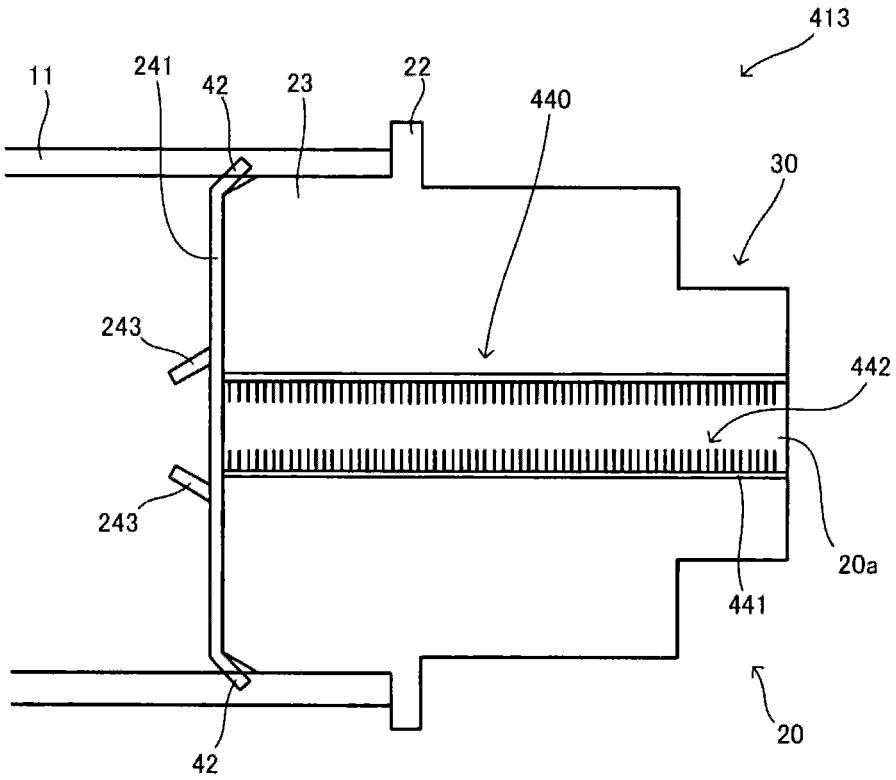
FIG. 25 is a view showing a torque transmitting member 413 according to a fifth embodiment.

FIG. 25 is a view illustrating a fifth embodiment, and is a view corresponding to FIG. 24. In the fifth embodiment, a torque transmitting member 413 is provided and a conducting shaft member 440 is provided here instead of the conducting shaft member 340 of the conducting means.

The conducting shaft member 440 includes a base portion 441 and a contact portion 442.

The base portion 441 is a conducting member which is disposed on at least a part of the inner surface of the hole 20*a* of the end member 20 and extends in the axial direction and of which one end portion comes into contact with the ground plate 241 and the other end portion reaches the vicinity of an opening portion of the hole 20*a* opposite to the ground plate 241.

The contact portion 442 is a member formed of a metal brush or metal wool that functions as a conductive material formed so as to protrude from the base portion 441 and is elastically deformed, and has conductivity.

Accordingly, since the base portion 441 and the contact portion 442 come into contact with each other and the base portion 441 comes into contact with the ground plate 241, the base portion 441, the contact portion 442, and the ground plate 241 can conduct electricity.

Here, the contact portion 442 protrudes toward the inside of the hole 20*a* so as to come into sufficient contact with the body-side ground member 53 when the body-side ground member 53 is inserted into the hole 20*a* of the end member 20. Accordingly, when the photosensitive drum unit 10 is mounted on the apparatus body 2, the contact portion 442 comes into contact with the body-side ground member 53 at a posture where the body-side ground member 53 is inserted into the hole 20*a* of the end member 20. Therefore, electricity is conducted through a path of the base portion 441, the ground plate 241, and the photosensitive drum 11. In this case, since the body-side ground member 53 is inserted while elastically deforming the metal brush or metal wool of the contact portion 442, it is possible to obtain a good contact state.

In the torque transmitting member 413, even when the body-side ground member 53 moves in the axial direction, the body-side ground member 53 merely moves while elastically deforming the contact portion 442 and the tip of the body-side ground member 53 does not come into contact with the ground plate 241. Accordingly, since the ground plate 241 is almost not affected by the movement of the body-side ground member 53 in the axial direction, the same effect as the effect of the above-mentioned torque transmitting member is obtained.

Figure 26:
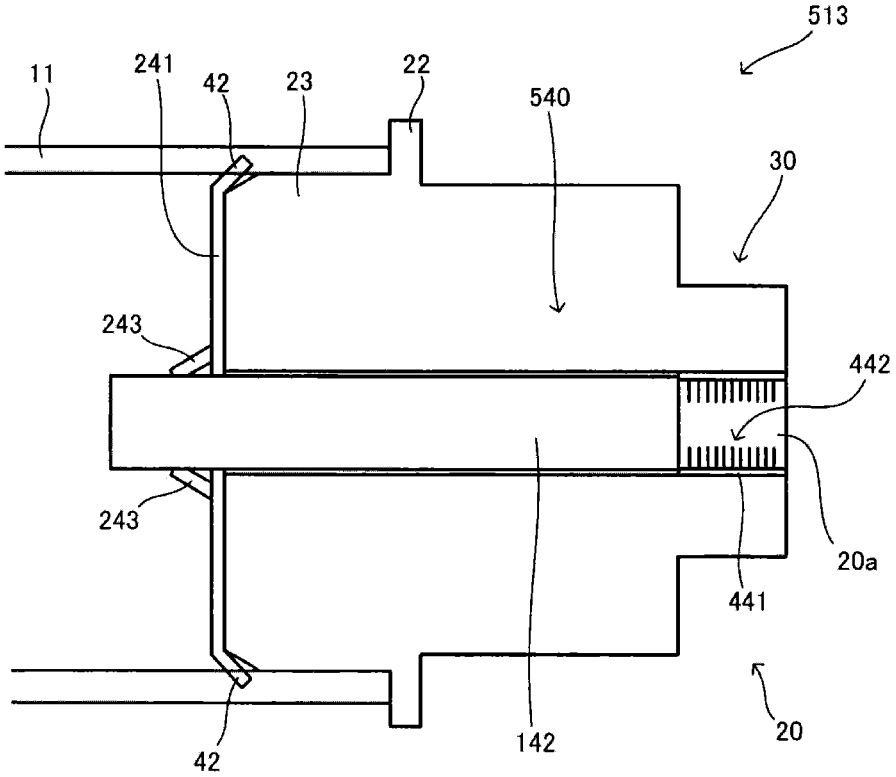
FIG. 26 is a view showing a torque transmitting member 513 according to a sixth embodiment.

FIG. 26 is a view illustrating a sixth embodiment, and is a view corresponding to FIG. 25. In the sixth embodiment, a torque transmitting member 513 is provided and a conducting shaft member 540 is provided here instead of the conducting shaft member 440 of the conducting means.

The conducting shaft member 540 is an example in which a conducting shaft 142 is disposed between the conducting shaft member 440 described in the fifth embodiment and the ground plate 241. Accordingly, the conducting shaft member 540 includes the conducting shaft 142, the base portion 441, and the contact portion 442.

The conducting shaft 142 is the same as described above. In this embodiment, the conducting shaft 142 is disposed in the hole 20*a* of the end member 20 and one end of the conducting shaft 142 is connected to the ground plate 241. The other end portion of the conducting shaft 142 extends in the hole 20*a* toward the side opposite to the ground plate 241 and is formed short so as not to reach the opening portion by a predetermined distance.

The base portion 441 is disposed on at least a part of the inner surface of the hole 20*a* of the end member 20 and extends in the axial direction. One end portion of the base portion 441 comes into contact with the other end of the conducting shaft 142 and the other end portion of the base portion 441 reaches the vicinity of an opening portion of the hole 20*a* opposite to the side on which the ground plate 241 is disposed.

The contact portion 442 is a member formed of a metal brush or metal wool formed so as to protrude from the base portion 441 and elastically deformed, and has conductivity.

Accordingly, since the base portion 441 and the contact portion 442 come into contact with each other, the base portion 441 comes into contact with the conducting shaft 142, and the conducting shaft 142 comes into contact with the ground plate 241, the base portion 441, the contact portion 442, the conducting shaft 142, and the ground plate 241 conduct electricity.

Here, the contact portion 442 protrudes toward the inside of the hole 20*a* so as to come into sufficient contact with the body-side ground member 53 when the body-side ground member 53 is inserted into the hole 20*a* of the end member 20. Accordingly, when the photosensitive drum unit 10 is mounted on the apparatus body 2, the contact portion 442 comes into contact with the body-side ground member 53 at a posture where the body-side ground member 53 is inserted into the hole 20*a* of the end member 20. Therefore, electricity is conducted through a path of the base portion 441, the conducting shaft 142, the ground plate 241, and the photosensitive drum 11. In this case, since the body-side ground member 53 is inserted while elastically deforming the metal brush or metal wool of the contact portion 442, it is possible to obtain a good contact state.

In the torque transmitting member 513, even when the body-side ground member 53 moves in the axial direction, the body-side ground member 53 merely moves while elastically deforming the contact portion 442 and the tip of the body-side ground member 53 does not come into contact with the conducting shaft 142. Accordingly, since the conducting shaft 142 is almost not affected by the movement of the body-side ground member 53 in the axial direction, the same effect as the effect of the above-mentioned torque transmitting member is obtained.

This application is based on US Provisional Application (U.S. Patent Application No. 61/698,168) filed on Sep. 7, 2012, Japanese Utility Model Registration Application (Japanese Utility Model Registration Application No. 2012-06387) filed on Oct. 19, 2012, and Japanese Patent Application (Japanese Patent Application No. 2013-103332) filed on May 15, 2013, the disclosures of which are incorporated herein by reference in its entirety.

According to the invention, drive torque, which is transmitted from the apparatus body, is transmitted to the photosensitive drum. In this case, a pressing force, which is applied from the ground member of the apparatus body, is absorbed by the conducting shaft member that is elastically deformed. Accordingly, it is possible to appropriately maintain conductivity between the image forming apparatus body and the photosensitive drum, and to suppress the occurrence of conduction failure. Further, even though the bearing portion is pushed back from the apparatus body, the bearing portion is prevented from being pushed back together with the photosensitive drum by the absorption. Accordingly, the disengagement of the bearing portion from the apparatus body is also prevented.

What is claimed is:

1. A torque transmitting member that is disposed at an end portion of a photosensitive drum unit and transmits torque, the torque transmitting member comprising:

a cylindrical end member that includes a bearing portion at one end portion thereof and a fitting portion at the other end portion thereof, the fitting portion being inserted into a photosensitive drum; and a conductive conducting shaft member that is disposed so as to extend along a cylindrical shaft of the end member and includes a conductive material, which is elastically deformed, on at least a part thereof, wherein a ground plate, which is a conductive plate-like member, is disposed at a portion of the end member close to the fitting portion, and an end portion of the conducting shaft member comes into contact with the ground plate.

2. The torque transmitting member according to claim 1, wherein the conductive material is at least one of a coil spring, a conductive sheet, a brush made of metal, and wool made of metal.

3. The torque transmitting member according to claim 1, wherein the torque transmitting member is formed so that an end portion of the conducting shaft member is accessible from the bearing portion.

4. The torque transmitting member according to claim 1, wherein the conductive material, which is elastically deformed, of the conducting shaft member includes a coil spring, a hole is formed at the ground plate, and the coil spring is caught in the hole of the ground plate.

5. A photosensitive drum unit comprising:

a cylindrical photosensitive drum; and the torque transmitting member according to claim 1, wherein the fitting portion is inserted into at least one end portion of the photosensitive drum, so that the torque transmitting member is mounted.

6. A process cartridge comprising:

the photosensitive drum unit according to claim 5;

a charging roller that charges the photosensitive drum of the photosensitive drum unit; and a developing roller that develops an electrostatic latent image on the photosensitive drum, wherein the photosensitive drum unit, the charging roller, and the developing roller are held in a same housing.

* * * * *